US009277316B2

(12) United States Patent
Banba et al.

(10) Patent No.: US 9,277,316 B2
(45) Date of Patent: Mar. 1, 2016

(54) SOUND PROCESSING DEVICE AND SOUND PROCESSING METHOD

(75) Inventors: Yutaka Banba, Kanagawa (JP); Takeo Kanamori, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1147 days.

(21) Appl. No.: 13/258,171

(22) PCT Filed: Feb. 23, 2011

(86) PCT No.: PCT/JP2011/001031

§ 371 (c)(1),
(2), (4) Date: Sep. 21, 2011

(87) PCT Pub. No.: WO2011/105073

PCT Pub. Date: Sep. 1, 2011

(65) Prior Publication Data

US 2012/0008797 A1 Jan. 12, 2012

(30) Foreign Application Priority Data

Feb. 24, 2010 (JP) ..... 2010-038903

(51) Int. Cl.
*H04R 3/00* (2006.01)
*H04R 25/00* (2006.01)

(52) U.S. Cl.
CPC ..... *H04R 3/007* (2013.01); *H04R 3/005* (2013.01); *H04R 25/407* (2013.01); *H04R 25/55* (2013.01); *H04R 25/552* (2013.01); *H04R 2225/41* (2013.01)

(58) Field of Classification Search
CPC ..... H04R 3/005; H04R 5/04; H04R 25/45; H04R 25/407; H04R 25/55; H04R 25/552; H04R 2225/41
USPC ..... 381/57, 58, 97, 312, 313, 315, 317, 381/94.7
See application file for complete search history.

(56) References Cited

U.S. PATENT DOCUMENTS 5,479,522 A * 12/1995 Lindemann et al. ..... 381/23.1
5,732,045 A * 3/1998 Wagstaff et al. ..... 367/135

(Continued)

FOREIGN PATENT DOCUMENTS

CN 101569209 10/2009
CN 101589430 11/2009

(Continued)

OTHER PUBLICATIONS

China Office action, mail date Jan. 24, 2014 (English translation).

(Continued)

*Primary Examiner* — Davetta W Goins
*Assistant Examiner* — Daniel Sellers
(74) *Attorney, Agent, or Firm* — Greenblum & Bernstein, P.L.C.

(57) ABSTRACT

A sound processing apparatus which can improve precision of analyzes on ambient sounds, carries out analysis on the ambient sounds based upon collected sound signals acquired by two sound collectors. The sound processing apparatus is provided with a level signal converter that converts the collected sound signal into a level signal, which indicates an absolute value of the collected sound signal from which phase information is removed. A level signal synthesizer generates a synthesized level signal in which the level signals acquired from the collected sound signals of the two sound collectors are synthesized, and a detector/identifier carries out analysis on the ambient sounds, based upon the synthesized level signal.

12 Claims, 19 Drawing Sheets

(56) References Cited

U.S. PATENT DOCUMENTS

| | | | | |
|---|---|---|---|---|
| 5,867,581 | A * | 2/1999 | Obara | 381/312 |
| 5,991,419 | A * | 11/1999 | Brander | 381/312 |
| 6,023,517 | A | 2/2000 | Ishige | |
| 7,206,421 | B1 * | 4/2007 | Taenzer | 381/119 |
| 8,255,222 | B2 | 8/2012 | Hirose et al. | |
| 8,311,236 | B2 | 11/2012 | Kanamori | |
| 2008/0079571 | A1 * | 4/2008 | Samadani | 340/552 |
| 2008/0181419 | A1 * | 7/2008 | Goldstein et al. | 381/57 |
| 2008/0240458 | A1 * | 10/2008 | Goldstein et al. | 381/72 |
| 2008/0260180 | A1 * | 10/2008 | Goldstein et al. | 381/110 |
| 2010/0004934 | A1 | 1/2010 | Hirose et al. | |
| 2010/0026858 | A1 | 2/2010 | Kanamori | |

FOREIGN PATENT DOCUMENTS

| | | |
|---|---|---|
| JP | 10-126890 | 5/1998 |
| JP | 2000-098015 | 4/2000 |
| JP | 2009-212690 | 9/2009 |
| JP | 2009-218764 | 9/2009 |

OTHER PUBLICATIONS

China Office action, mail date is Apr. 3, 2014 (English translation).

* cited by examiner

SOUND PROCESSING DEVICE AND SOUND PROCESSING METHOD

TECHNICAL FIELD

The present invention relates to sound processing apparatus and a sound processing method that analyzes ambient sound based upon collected sound signals from two sound collectors.

BACKGROUND ART

As a sound processing apparatus for analyzing ambient sound and for carrying out various detections, conventionally, for example, patent literature 1 has proposed a device (hereinafter referred to as "conventional apparatus").

The conventional apparatus respectively converts collected sound signals from two sound collectors attached to right and left sides of an object of analysis of ambient sound to level signals indicating sound pressure levels. Moreover, the conventional apparatus analyzes ambient sound on the left side based upon the level signal derived from a collected sound signal of the sound collector on the left side. Furthermore, the conventional apparatus analyzes ambient sound on the right side based upon the level signal derived from a collected sound signal of the sound collector on the right side. With this arrangement, the conventional apparatus can analyze ambient sound, such as analysis of the arrival direction of sound, with respect to directions in a wide range.

CITATION LIST

Patent Literature

PTL 1
Japanese Patent Application Laid-Open No. 2000-98015

SUMMARY OF INVENTION

Technical Problem

Here, in the case when the two sound collectors are used, sounds from respective sound sources are collected at different two points. Consequently, the conventional apparatus needs to improve the accuracy of analysis of ambient sound by carrying out analysis using both of two collected sound signals for each of directions.

In this case, however, the conventional apparatus has a problem in which it is difficult to improve the accuracy of analysis of ambient sound even when such analysis is carried out. The reasons for this are explained as follows:

FIG. 1 is a drawing that shows the results of experiments of directivity characteristics for each frequency of a level signal obtained from one sound collector. In this case, the directivity characteristics of a level signal obtained from a sound collector attached to the right ear of a person are shown. In the drawing, one scale in the radial direction corresponds to 10 dB. Moreover, with respect to directions, based upon the front direction of the person as a reference, directions relative to the head are defined by angles in clockwise obtained when viewed from above.

In FIG. 1, lines 911 to 914 respectively indicate directivity characteristics of respective level signals at frequencies of 200 Hz, 400 Hz, 800 Hz and 1600 Hz in succession. Sounds that reach the right ear side from the left side of the head are subject to great acoustic influence by the presence of the head.

Therefore, as shown in FIG. 1, near the left side (near 270°) of the head, the level signal of each frequency is attenuated.

Moreover, the acoustic influence caused by the head become stronger as the frequency of a sound becomes higher. In the example of FIG. 1, for example, a level signal having a frequency of 1600 Hz is attenuated by about 15 dB in the vicinity of 240° as indicated by line 914.

This un-uniformity of directivity characteristics of the level signal due to attenuation may occur in the case when the object of analysis of ambient sound is other than the head of a person. When the directivity characteristics of a level signal are un-uniform, the level signal fails to reflect the state of ambient sound with high accuracy. Consequently, in the related art, even when analysis is carried out by using the two collected sound signals for each of directions, it is difficult to improve the accuracy of analysis of ambient sound.

It is therefore an object of the present invention to provide a sound processing apparatus and a sound processing method that can improve the accuracy of analysis of ambient sound.

Solution to Problem

A sound processing apparatus of the present invention, which analyzes ambient sound based upon collected sound signals acquired by two sound collectors, is provided with: a level signal conversion section which, for each of collected sound signals, converts the collected sound signal into a level signal, from which phase information is removed; a level signal synthesizing section that generates a synthesized level signal in which the level signals obtained from the collected sound signals from the two sound collectors are synthesized; and a detecting and identifying section that analyzes the ambient sound based upon the synthesized level signal.

A sound processing method of the present invention, which analyzes ambient sound based upon collected sound signals acquired by two sound collectors, is provided with: steps of, for each of the collected sound signals, converting the collected sound signal into a level signal, from which phase information is removed; generating a synthesized level signal in which the level signals obtained from the collected sound signals from the two sound collectors are synthesized; and analyzing the ambient sound based upon the synthesized level signal.

Advantageous Effects of Invention

According to the present invention, it is possible to improve the accuracy of analysis of ambient sound.

DESCRIPTION OF EMBODIMENTS

Referring to FIGS., the following description will discuss embodiments of the present invention in detail.

Embodiment 1

Embodiment 1 of the present invention relates to an example in which the present invention is applied to a pair of ear-attaching-type hearing aids that are attached to two ears of a person. The respective sections of a sound processing apparatus to be explained below are realized by hardware including microphones, speakers, a CPU (central processing unit), a memory medium such as a ROM (read only memory) that stores a control program and a communication circuit, which are placed in the insides of a pair of hearing aids.

Moreover, in the following description, of the paired hearing aids, the hearing aid to be attached to the right ear is referred to as "right-side hearing aid" (first apparatus, or first side hearing aid), and the hearing aid to be attached to the left ear is referred to as "left-side hearing aid" (second apparatus, or second side hearing aid).

Figure 2:
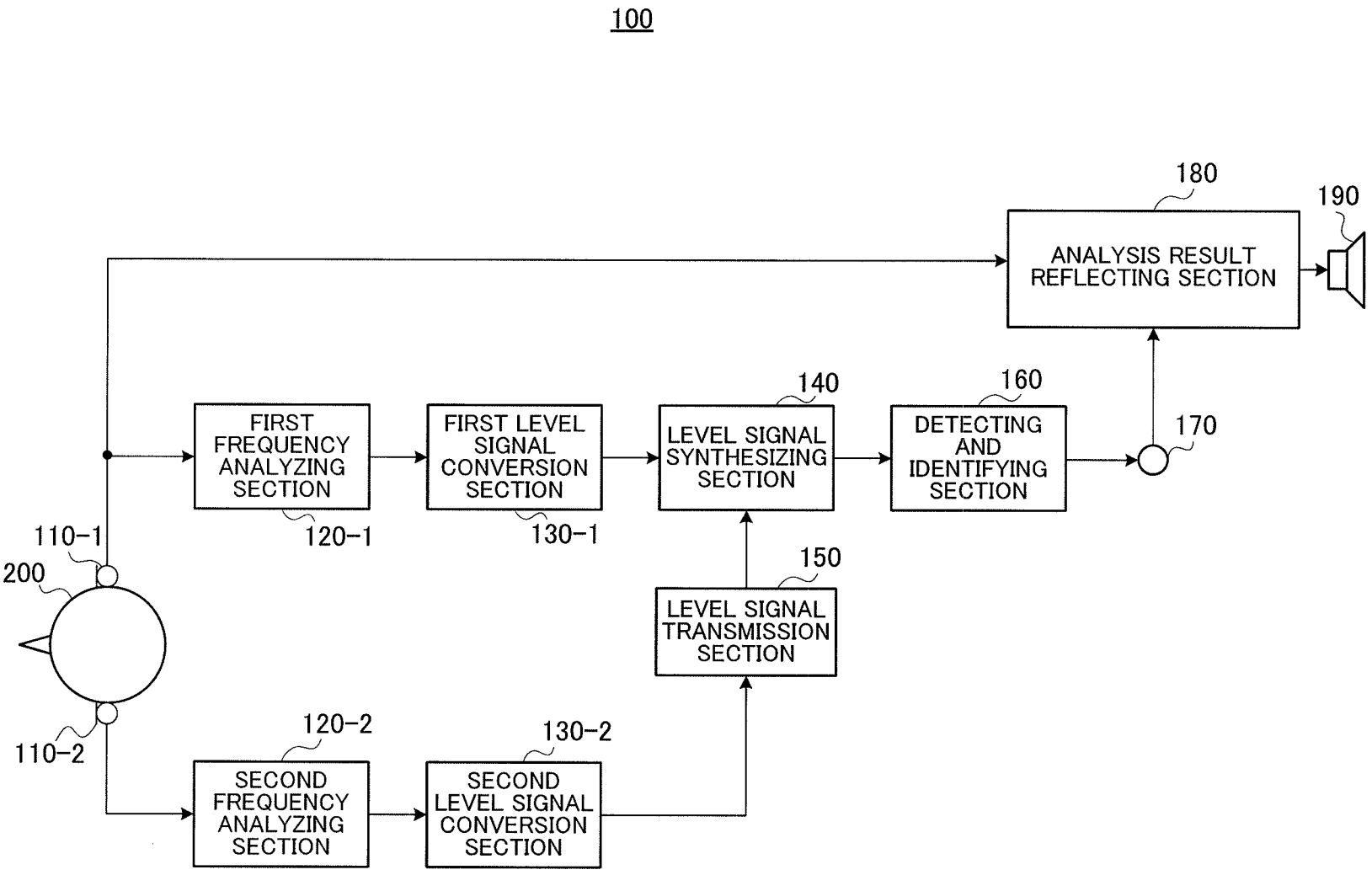
FIG. 2 is a block diagram that shows one example of a configuration of a sound processing apparatus in accordance with Embodiment 1 of the present invention.

FIG. 2 is a block diagram that shows one example of a configuration of a sound processing apparatus according to the present embodiment.

As shown in FIG. 2, sound processing apparatus 100 is provided with first sound collector (microphone) 110-1, first frequency analyzing section 120-1, first level signal conversion section 130-1, level signal synthesizing section 140, detecting and identifying section 160, output section 170, analysis result reflecting section (sound/voice control section) 180 and sound/voice output section (speaker) 190, which serve as functional sections placed in the right-side hearing aid. Moreover, sound processing apparatus 100 is also provided with second sound collector (microphone) 110-2, second frequency analyzing section 120-2, second level signal conversion section 130-2 and level signal transmission section 150, which serve as functional sections placed in the left-side hearing aid.

Figure 3:
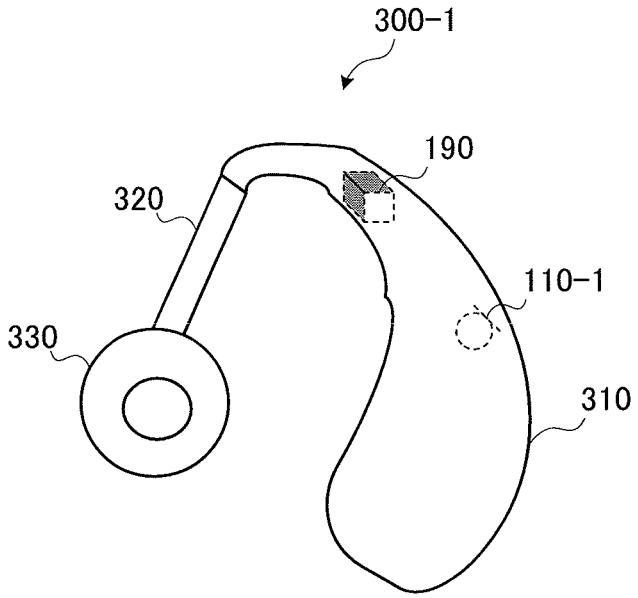
FIG. 3 is a drawing that shows one example of an outside appearance of a right-side hearing aid in accordance with Embodiment 1.

FIG. 3 is a drawing that shows one example of an outside appearance of the right-side hearing aid.

As shown in FIG. 3, right-side hearing aid 300-1 is provided with hearing aid main body 310, sound tube 320 and earphone 330. Although not shown in the FIGS., left-side hearing aid 300-2 also has the same external configuration as that of right-side hearing aid 300-1, with a laterally symmetric layout.

Figure 4:
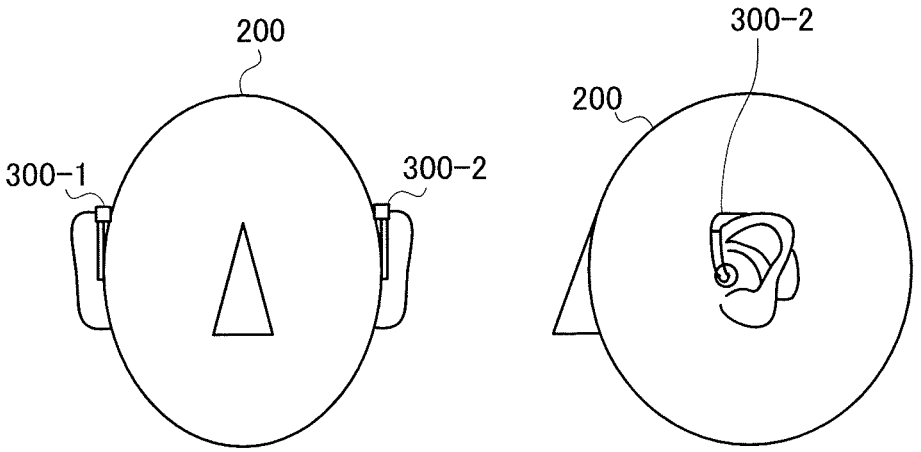
FIG. 4 is a drawing that shows an attached state of the hearing aid in accordance with Embodiment 1.

FIG. 4 is a drawing that shows an attached state of the hearing aid.

As shown in FIG. 4, right-side hearing aid 300-1 is attached to the right ear of a person, and secured to the right side of head 200. Moreover, left-side hearing aid 300-2 is attached to the left ear of the person, and secured to the left side of head 200.

Referring again to FIG. 2, the explanation will be continued. First sound collector 110-1 is a non-directive microphone (see FIG. 4) housed in hearing aid main body 310 of right-side hearing aid 300-1. First sound collector 110-1 collects ambient sound around head 200 through a hole such as a slit, and generates a first collected sound signal. First sound collector 110-1 outputs the first collected sound signal thus generated to first frequency analyzing section 120-1 and analysis result reflecting section 180.

First frequency analyzing section 120-1 converts the first collected sound signal into frequency signals for respective frequency bands, and outputs these signals to first level signal conversion section 130-1 as first frequency signals. In the present embodiment, first frequency analyzing section 120-1 generates a first frequency signal for each of a plurality of frequency bands. First frequency analyzing section 120-1 may carry out the conversion to a frequency signal, by using, for example, a plurality of band-pass filters, or based upon FFT (Fast Fourier Transform) that converts time-domain waveforms into frequency spectra.

Figure 5:
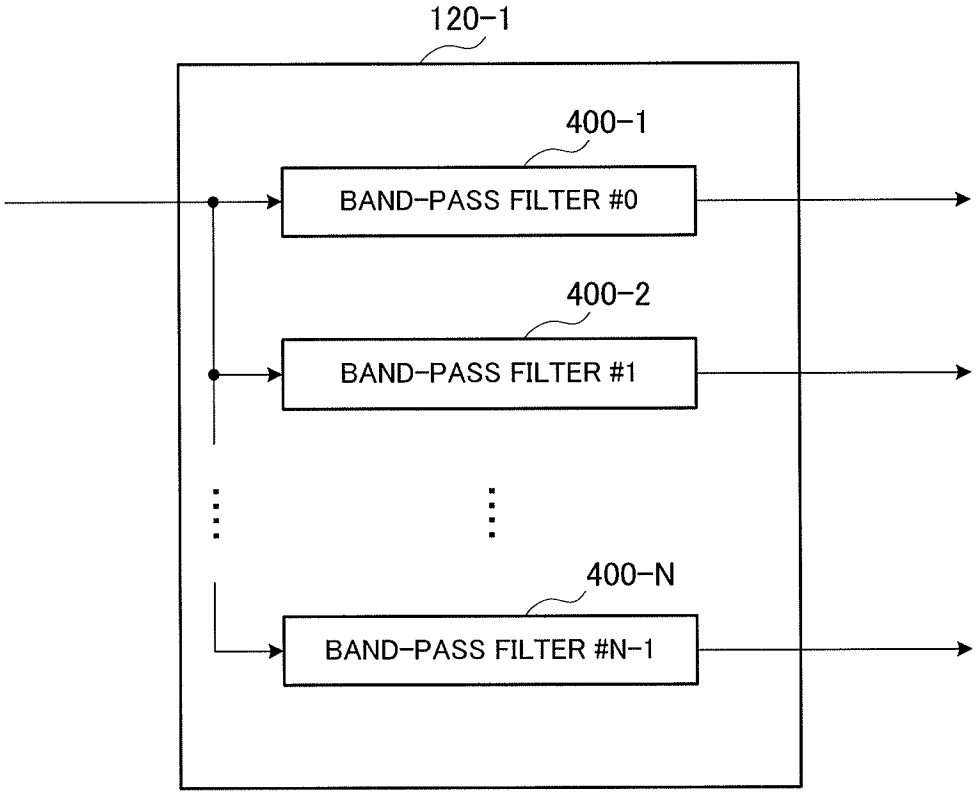
FIG. 5 is a block diagram that shows one example of a configuration of a first frequency analyzing section in accordance with Embodiment 1.

FIG. 5 is a block diagram that shows one example of a configuration of first frequency analyzing section 120-1 that utilizes an N-division filter bank. As shown in FIG. 5, first frequency analyzing section 120-1 is constituted by N-number of band-pass filters 400-1 to 400-N. Band-pass filters 400-1 to 400-N carry out a filtering process on a first collected sound signal by using different pass bands.

Figure 6:
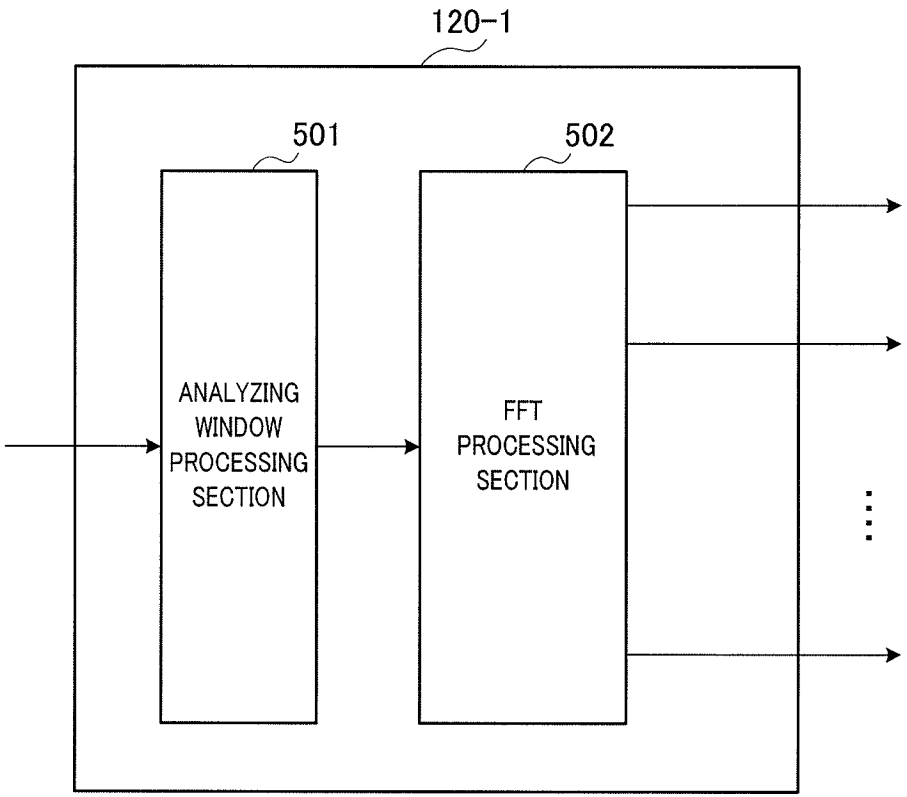
FIG. 6 is a block diagram that shows another example of a configuration of a first frequency analyzing section in accordance with Embodiment 1.

FIG. 6 is a block diagram that shows one example of a configuration of first frequency analyzing section 120-1 that utilizes the FFT. As shown in FIG. 6, first frequency analyzing section 120-1 is provided with, for example, analyzing window processing section 501 and FFT processing section 502.

Analyzing window processing section 501 provides an analyzing window to a first collected sound signal. As this analyzing window, from the viewpoints of spectrum leak prevention and frequency resolution, a window function that is fitted to the detecting and identifying processes of the succeeding step is selected. FFT processing section 502 converts a signal obtained through the analyzing window from a time-domain waveform to a frequency signal. That is, the first frequency signal, output by first frequency analyzing section 120-1 in this case, forms a complex frequency spectrum.

First level signal conversion section 130-1, shown in FIG. 2, converts a first frequency signal into a signal that represents a sound pressure level, and outputs this to level signal synthesizing section 140 as a first level signal. That is, first level signal conversion section 130-1 converts the first frequency signal into a first level signal prepared by removing phase information therefrom. In the present embodiment, first level signal conversion section 130-1 is designed to generate a signal prepared by removing the absolute value from the first frequency signal as a first level signal. That is, the first level signal corresponds to the absolute value amplitude of the first frequency signal. Additionally, in the case when the first frequency signal is a complex frequency spectrum derived from the FFT, the first level signal forms an amplitude spectrum or a power spectrum.

Moreover, second sound collector 110-2 is a non-directive microphone housed in the left-side hearing aid, and generates a second collected sound signal by collecting ambient sound around head 200 in the same manner as in first sound collector 110-1, and outputs this to second frequency analyzing section 120-2.

In the same manner as in first frequency analyzing section 120-1, second frequency analyzing section 120-2 converts the second collected sound signal into a frequency signal, and outputs this to second level signal conversion section 130-2 as the second frequency signal.

Level signal transmission section 150 transmits the second level signal generated in the left-side hearing aid to level signal synthesizing section 140 placed on the right-side hearing aid. Level signal transmission section 150 can utilize radio communication and cable communication as the transmission means. In this case, as the transmission mode of level signal transmission section 150, such a mode as to ensure a sufficient transmission capacity capable of transmitting second level signals of all the bands is adopted.

Level signal synthesizing section 140 synthesizes the first level signal and the second level signal to generate a synthesized level signal, and outputs this to detecting and identifying section 160. In the present embodiment, level signal synthesizing section 140 adds the first level signal and the second level signal for each of the frequency bands so that the resulting signal is prepared as the synthesized level signal.

Based upon the synthesized level signal, detecting and identifying section 160 analyzes ambient sound around a head of a person to whom the hearing aids are attached, and outputs the analysis result to output section 170. This analysis corresponds to various detecting and identifying processes carried out in response to the synthesized level signal for each of the frequency bands.

Output section 170 outputs the result of analysis of ambient sound to analysis result reflecting section 180.

Analysis result reflecting section 180 carries out various processes based upon the analysis result of ambient sound. These processes are various signal processes that are carried out on the collected sound signal until it has been expanded by sound/voice output section 190 as sound waves, and include a directional characteristic synthesizing process and various suppressing and controlling processes. Moreover, these processes also include a predetermined warning process that is carried out upon detection of a predetermined sound from ambient sound.

Sound/voice output section 190 is a small-size speaker (see FIG. 4) housed in hearing aid main body 310 of right-side hearing aid 300-1. Sound/voice output section 190 converts the first collected sound signal into sound, and outputs the sound (i.e. sound amplification). Additionally, the output voice of sound/voice output section 190 is allowed to pass through acoustic tube 320, and released into the ear hole from earphone 330 placed into the ear hole.

This sound processing apparatus 100 syntheses the first level signal and the second level signal to generate a synthesized level signal, and analyzes the ambient sound based upon this synthesized level signal. Thus, sound processing apparatus 100 makes it possible to obtain such level signals of ambient sound as to compensate for an attenuation occurring in the first level signal by the second level signal, as well as compensating for an attenuation occurring in the second level signal by the first level signal, as synthesized level signals.

Moreover, since sound processing apparatus 100 synthesizes the first level signal and second level signal from which phase information has been removed, it can obtain the synthesized level signal without allowing pieces of information indicating the respective sound-pressure levels to cancel each other.

The following description will explain the effect obtained by synthesizing not the signal (for example, the frequency signal) prior to the removal of the phase information, but the signal (in this case, the level signal) after the removal of the phase information.

In order to alleviate unevenness of the directivity characteristics of the level signal and consequently to obtain a frequency spectrum and a sound pressure sensitivity level that are not dependent on a sound-source direction, it is proposed that the synthesized level signal between the first level signal and the second level signal should be used as described above. In other words, it is proposed that the first frequency signal generated from first sound collector 110-1 and the second frequency signal generated from second sound collector 110-2 are simply added to each other. This process is equivalent to a synthesizing process between signals prior to removal of phase information.

Figure 7:
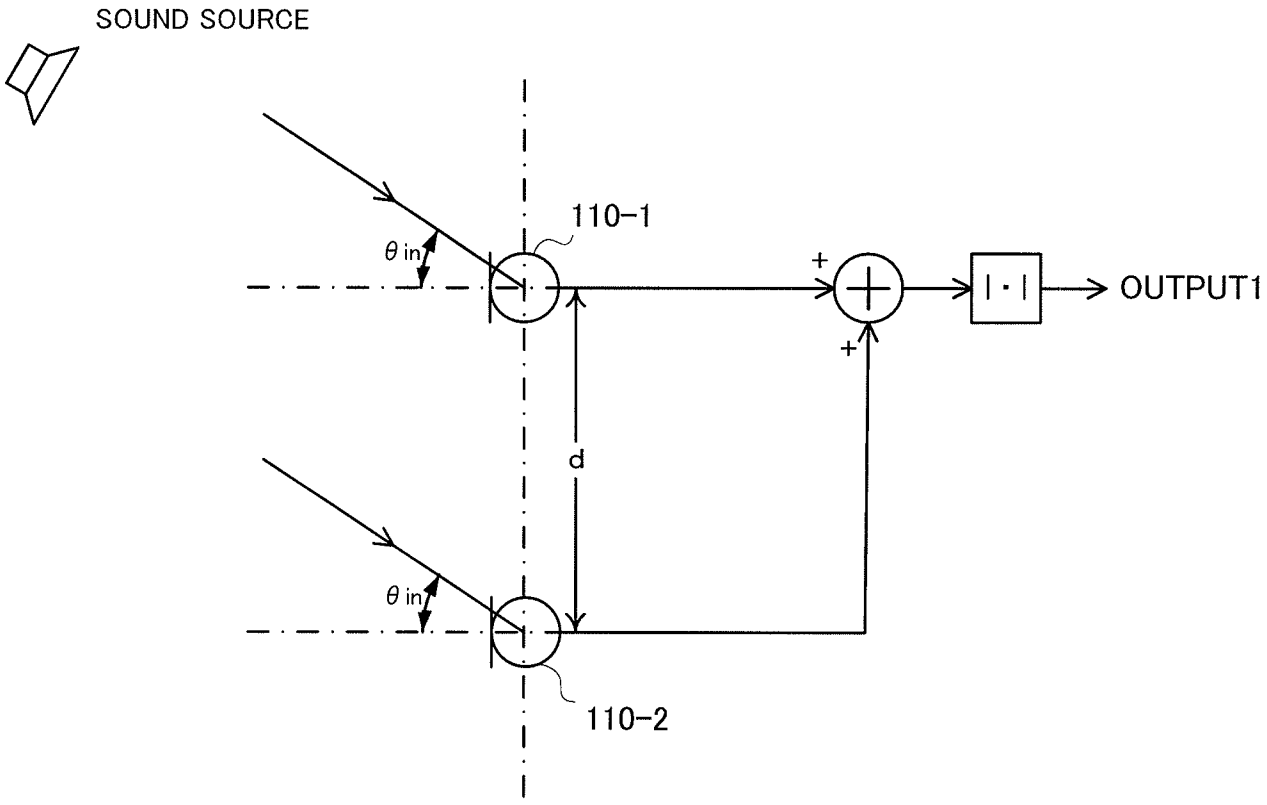
FIG. 7 is a drawing that schematically shows a state in which signals prior to removal of phase information therefrom are synthesized.

FIG. 7 is a drawing that schematically shows a state in which signals prior to the removal of phase information are synthesized.

In this case, for simplicity of explanation, as shown in FIG. 7, first sound collector 110-1 and second sound collector 110-2 are supposed to be linearly aligned with each other. As shown in FIG. 7, the first frequency signal and the second frequency signal, respectively generated by first sound collector 110-1 and second sound collector 110-2, as they are, are added to each other. Moreover, the signal after the addition, taken as the absolute value, is output as a synthesized level signal (output 1). The synthesized level signal forms an output amplitude value of a so-called non-directive microphone array constituted by first sound collector 110-1 and second sound collector 110-2.

In this state, suppose that a sound source (incident wave signal) having a frequency f is made incident on first sound collector 110-1 and second sound collector 110-2 in a direction of θin as plane waves. In this case, an array output amplitude characteristic $|H1(\omega, \theta in)|$ represented by an output amplitude value (output 1) relative to the frequency of the incident wave signal is indicated by the following equation 1. Here, d represents a distance (m) between microphones, c represents an acoustic velocity (m/sec.), and ω represents an angular frequency of an incident wave signal indicated by ω=2×π×f.

Equation 1

$$|H1(\omega, \theta in)| = \left|1 + e^{-j\omega\left(\frac{d\sin\theta in}{c}\right)}\right| \quad [1]$$

In equation 1, in the exponential corresponding to the phase term of a second frequency signal, as −ω{(d sin θin)/c} approaches π, the absolute value on the right side approaches 0. Then, |H1(ω, θin)| on the left side becomes the minimum to cause a dip. That is, the first frequency signal and the second frequency signal can be cancelled by a phase difference between the sound waves that reach first sound collector 110-1 and second sound collector 110-2.

Figure 8:
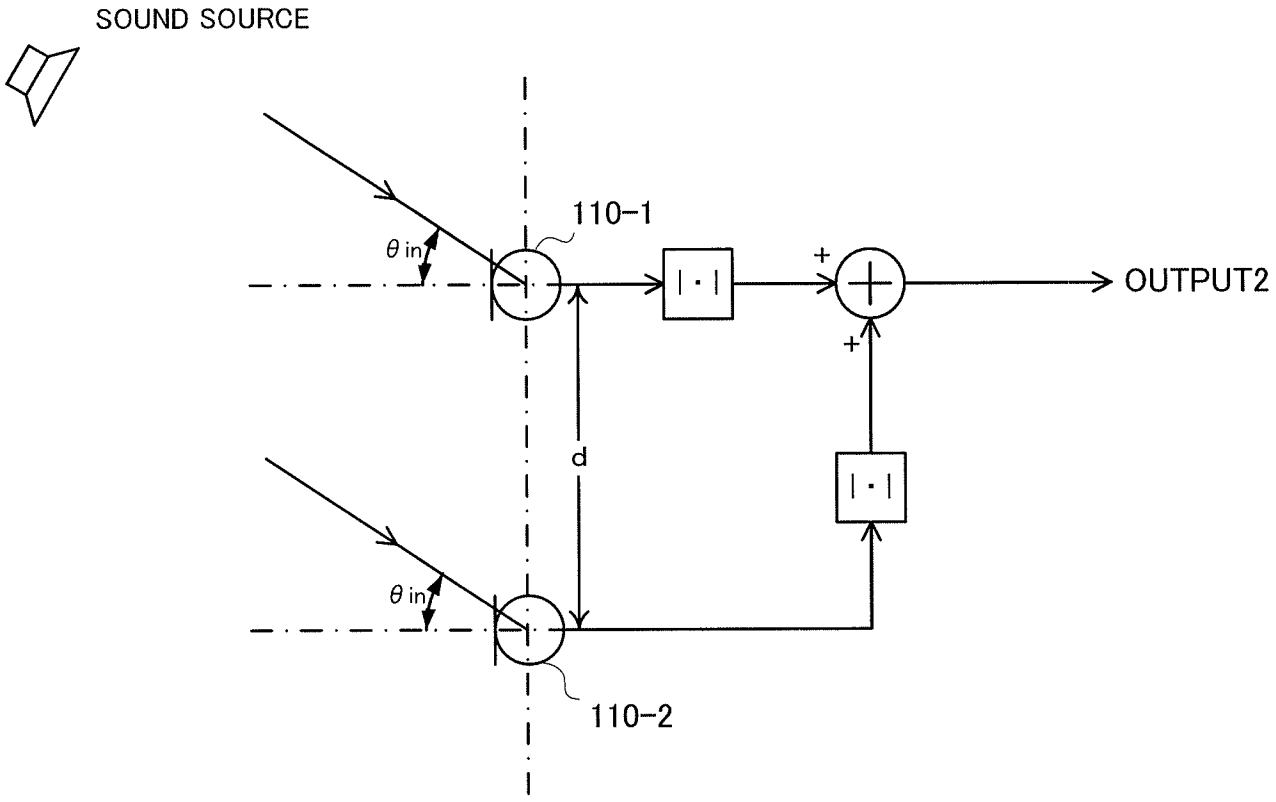
FIG. 8 is a drawing that schematically shows a state in which signals after the removal of phase information therefrom are synthesized in Embodiment 1.

FIG. 8 is a drawing that schematically shows a state in which signals after the removal of phase information thereof are synthesized with each other, and this drawing corresponds to FIG. 7.

As shown in FIG. 8, the first frequency signal and the second frequency signal respectively generated by first sound collector 110-1 and second sound collector 110-2 are converted to the first level signal and the second level signal in which the respective absolute values are taken. Moreover, the first level signal and the second level signal, converted to the absolute values, are added to each other, and the resulting signal is output as a synthesized level signal (output 2). The synthesized level signal forms an output amplitude value of a so-called non-directive microphone array constituted by first sound collector 110-1 and second sound collector 110-2.

In this case, an array output amplitude characteristic |H2(ω, θin)| indicated by the output amplitude value (output 2) relative to the frequency of the incident wave signal is represented by the following equation 2.

Equation 2

$$|H2(\omega, \theta in)| = |1| + \left|e^{-j\omega\left(\frac{d\sin\theta in}{c}\right)}\right| \quad [2]$$

In equation 2, different from equation 1, since the right side has a constant value (=2) independent of conditions, no dip occurs. In other words, even when there is a phase difference between sound waves that respectively reach first sound collector 110-1 and second sound collector 110-2, the first frequency signal and the second frequency signals are not cancelled with each other due to this difference.

Figure 9:
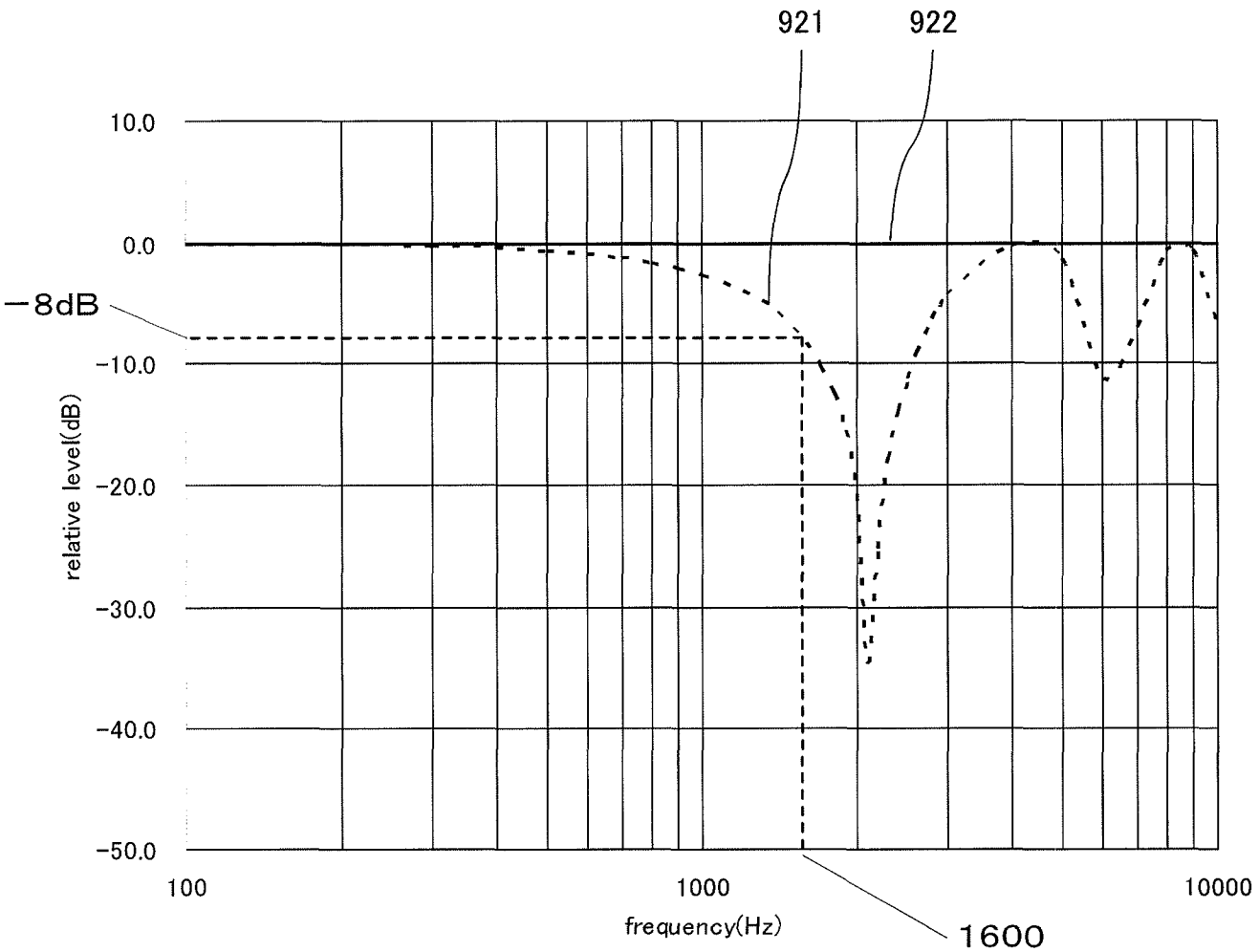
FIG. 9 is a drawing that shows a logarithmic characteristic relative to a frequency of an incident wave signal in the respective states in FIGS. 7 and 8.

FIG. 9 is a drawing that shows a logarithmic characteristic relative to a frequency of an incident wave signal in the respective states in FIGS. 7 and 8. In this case, supposing that the distance d between microphones is defined as 0.16 (m) corresponding to a distance between the right and left ears via the head, and that the incident angle θin is 30 (degrees), the experimental results of the logarithmic characteristic are shown.

As shown in FIG. 9, in the case when signals prior to the removal of phase information are synthesized with each other (see FIG. 7), the logarithmic characteristic 921 (|H1(ω, θin)|) of the output amplitude value (output 1) is kept comparatively constant within a low frequency band. However, the logarithmic characteristic 921 (|H1(ω, θin)|) of the output amplitude value (output 1) is fluctuated when the frequency becomes higher, and for example, at 1600 Hz, an attenuation of about 8 dB occurs. This attenuation is caused by a space aliasing phenomenon that occurs depending on a relationship (see (equation 1) between the distance (distance between the two ears) of first sound collector 110-1 and second sound collector 110-2 and wavelengths of sound waves. This local attenuation in the level signal due to the space aliasing phenomenon is, hereinafter, referred to as "a dip."

On the other hand, as shown in FIG. 9, in the case when signals after the removal of phase information thereof are synthesized with each other (see FIG. 8), the logarithmic characteristic 922 (|H2(ω, θin)|) of the output amplitude value (output 2) is not attenuated, and kept at a constant value independent of frequencies of an incident wave signal.

Figure 1:
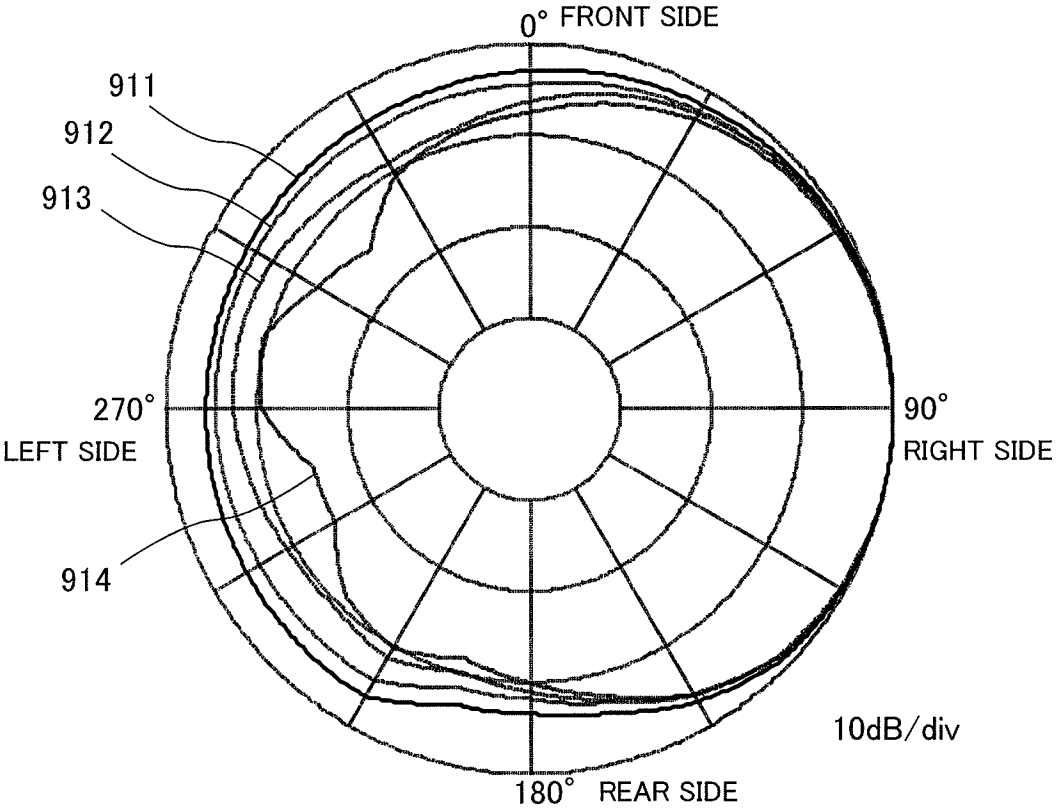
FIG. 1 is a drawing that shows the results of experiments of a directional characteristic of a level signal obtained from one sound collector in accordance with the related art technique.
Figure 10:
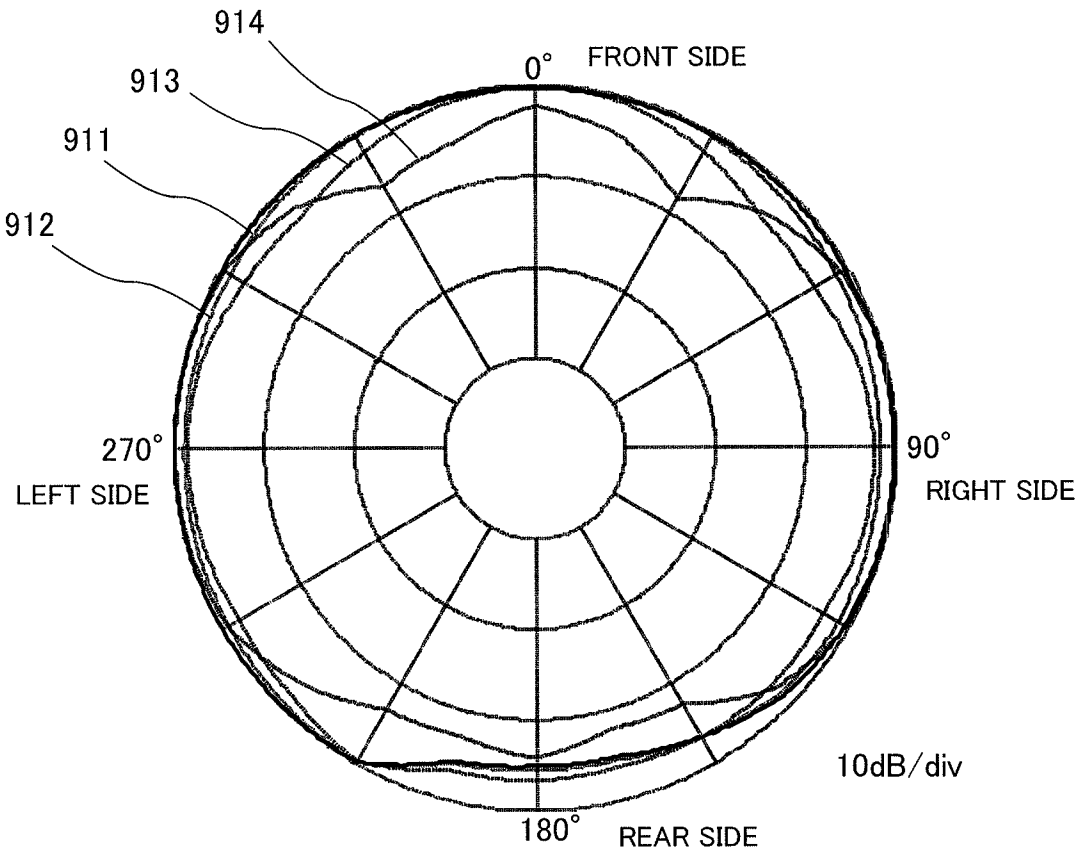
FIG. 10 is a drawing that shows experimental results of a directional characteristic in the case when signals prior to the removal of phase information therefrom are synthesized.

FIG. 10 is a drawing that corresponds to FIG. 1, and shows experimental results of directivity characteristics for each of frequencies in the case when signals prior to the removal of phase information therefrom are synthesized (see FIG. 7).

As shown in FIG. 10, a directional characteristic 914 of a level signal in the frequency of 1600 Hz has dips, for example, in the direction of 30 degrees as well as in the direction of 330 degrees. This is caused by the attenuation of the logarithmic characteristics, as explained in FIG. 9.

Figure 11:
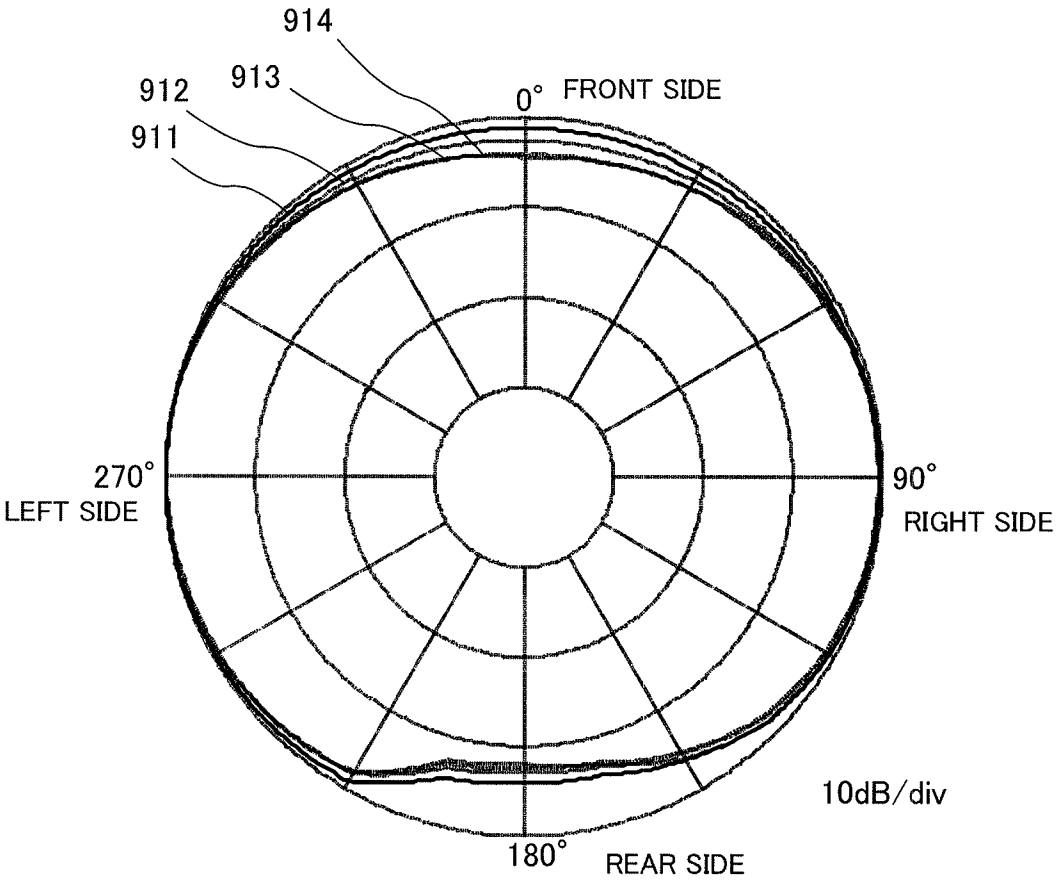
FIG. 11 is a drawing that shows experimental results of a directional characteristic in the case when signals after the removal of phase information therefrom are synthesized in Embodiment 1.

FIG. 11 is a drawing that corresponds to FIGS. 1 and 10, and shows experimental results of directivity characteristics for each of frequencies in the case when signals after the removal of phase information therefrom are synthesized (see FIG. 8).

As shown in FIG. 11, none of directivity characteristics 911 to 914 for the level signals of the respective frequencies have dips.

In this manner, by synthesizing signals (level signals in this case) after the removal of phase information therefrom, occurrences of dips due to a space aliasing phenomenon can be avoided so that the synthesized level signal is obtained as a level signal having uniform directivity characteristics.

As described above, sound processing apparatus 100 has first level signal conversion section 130-1 and second level signal conversion section 130-2 so that level signals after the removal of phase information therefrom are added to each other. For this reason, sound processing apparatus 100 makes it possible to avoid phase interferences due to a space aliasing phenomenon so that, as shown in FIG. 11, a uniform sound pressure frequency characteristic that is not dependent on arriving directions of sound waves (uniform directional characteristic for each of frequencies) can be obtained.

As described above, by synthesizing signals after the removal of phase information therefrom, sound processing apparatus 100 according to the present embodiment makes it possible to obtain a uniform amplitude characteristic regardless of frequencies. Therefore, sound processing apparatus 100 makes it possible to equalize directivity characteristics by synthesizing two signals, while preventing a problem in that by synthesizing two signals, amplitude characteristics of ambient sound all the more deteriorate.

The following description will discuss operations of sound processing apparatus 100.

Figure 12:
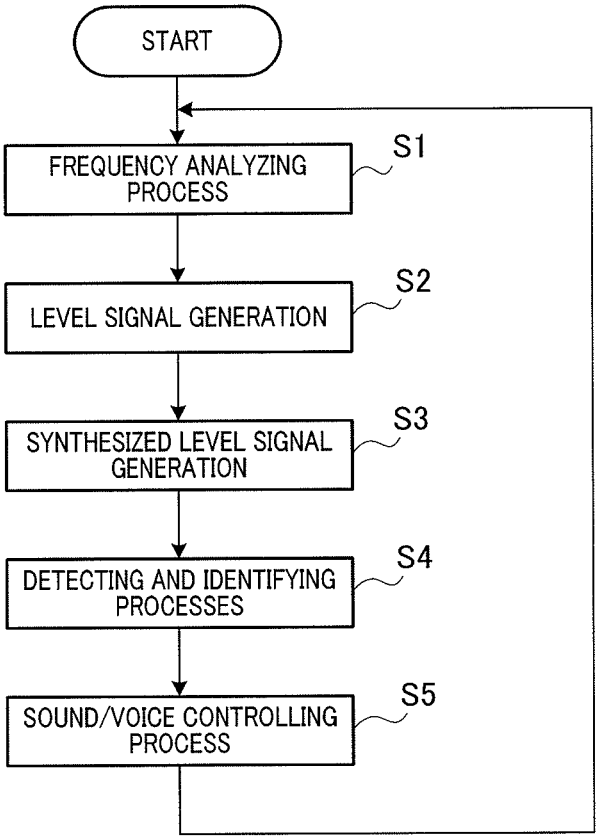
FIG. 12 is a flow chart that shows one example of operations in a sound processing apparatus in accordance with Embodiment 1.

FIG. 12 is a flow chart that shows one example of operations of sound processing apparatus 100. Sound processing apparatus 100 starts operations, for example, as shown in FIG. 12, upon turning on a power supply, or upon turning on a function relating to analysis, and finishes the operations upon turning off the power supply, or upon turning off the function relating to analysis.

First, in step S1, first frequency analyzing section 120-1 converts a collected sound signal input from first sound collector 110-1 into a plurality of first frequency signals. Moreover, in the same manner, second frequency analyzing section

120-2 converts a collected sound signal input from second sound collector 110-2 into a plurality of second frequency signals. For example, first frequency analyzing section 120-1 and second frequency analyzing section 120-2 are supposed to have a configuration that uses a filter bank explained by reference to FIG. 5. In this case, the first frequency signal and the second frequency signal have time-domain waveforms having bandwidths limited by respective bandpass filters.

Moreover, in step S2, first level signal conversion section 130-1 generates a first level signal formed by removing phase information from the first frequency signal output from first frequency analyzing section 120-1. In the same manner, second level signal conversion section 130-2 generates a second level signal formed by removing phase information from the second frequency signal output from second frequency analyzing section 120-2. The second level signal is transmitted to level signal synthesizing section 140 of the right-side hearing aid through level signal transmission section 150. Additionally, at this time, level signal transmission section 150 may transmit a second level signal (compressed second level signal) from which information has been made thinner on the time axis. Thus, level signal transmission section 150 makes it possible to cut the amount of data transmission.

Moreover, in step S3, level signal synthesizing section 140 adds the first level signal to the second level signal so that a synthesized level signal is generated.

In step S4, detecting and identifying section 160 carries out detecting and identifying processes by using the synthesized level signal. The detecting and identifying processes are processes in which, with respect to an audible band signal having a comparatively wide band, flatness, spectrum shape and the like of a spectrum are detected and identified, and, for example, these processes include a wide-band noise identifying process. Output section 170 outputs the results of the detection and identification.

Moreover, in step S5, analysis result reflecting section 180 carries out a sound/voice controlling process on the first collected sound signal based upon the results of detection and identification, and the sequence returns to step S1.

In this manner, sound processing apparatus 100 of the present embodiment adds two signals obtained from the two sound collectors attached to the right and left sides of the head to each other, after phase information has been removed therefrom, and synthesizes the signals. As described above, the signal (synthesized level signal in the present embodiment) thus obtained has a uniform directional characteristic around the head regardless of frequencies of the incident waves. Therefore, sound processing apparatus 100 can analyze ambient sound based upon signals in which both of acoustic influence of the head and the space aliasing phenomenon are suppressed, and consequently makes it possible to improve the accuracy of analysis of ambient sound. In other words, sound processing apparatus 100 makes it possible to reduce erroneous detections and erroneous identifications of a specific direction due to dips.

Moreover, sound processing apparatus 100 makes it possible to reduce fluctuations in frequency characteristics even when an arrival angle of incident waves onto the two sound collectors is changed due to a movement of a sound source or rotation or the like of the head (head swing), and consequently to stably detect and identify ambient sound around the head.

Embodiment 2

Embodiment 2 of the present invention exemplifies a configuration in which signals in a frequency band that are less susceptible to acoustic influence of the head, that is, level signals having a frequency band in which directivity characteristics of collected sound are not made significantly different between the two sound collectors, are not transmitted and are not subject to the synthesizing operation between the right and left sides. In other words, in the present embodiment, of the second level signals, not all the frequencies, but those frequencies having only the high band portions that have great attenuations due to the influences of the head are transmitted, and by synthesizing these with the first level signal, it becomes possible to cut the amount of transmission data.

As clearly shown by characteristics, for example, near 200 Hz and 400 Hz of FIG. 1, the level signal in a low-frequency band has none of great disturbances and deviations in directivity characteristics, although it has slight reduction in sensitivity on the head side. This is because in the low-frequency band (about 3 to 5 times or more longer than the longest portion of the head) having a wavelength significantly longer than the size of the head, the directivity characteristics are hardly influenced by the head because of diffraction of sound waves. That is, in the low-frequency band, directivity characteristics of collected sound are similar between the two sound collectors.

Therefore, in the present embodiment, the level signal in a low-frequency band is not subject to synthesizing processes between the right and left sides. In other words, in the sound processing apparatus of the present embodiment, with respect to the low-frequency band that is less susceptible to influences from the head, the addition of the right and left level signals and the transmission of one of the signals are omitted.

Additionally, in the explanation below, the "low band" refers to the frequency band in which directivity characteristics of collected sound is not significantly different between the two sound collectors in the audible frequency band, in an attached state of hearing aids as shown in FIG. 4. More specifically, the "low band" refers to a frequency band that is lower than a specific border frequency determined by experiments and the like. Furthermore, the "high band" refers to a frequency band that is excluded from the "low band" of the audible frequency bands. The size of the head of a person is virtually constant, and those frequency bands of 400 Hz to 800 Hz or less correspond to the frequency bands that are hardly influenced by the head. Therefore, the sound processing apparatus has, for example, 800 Hz as the border frequency.

Figure 13:
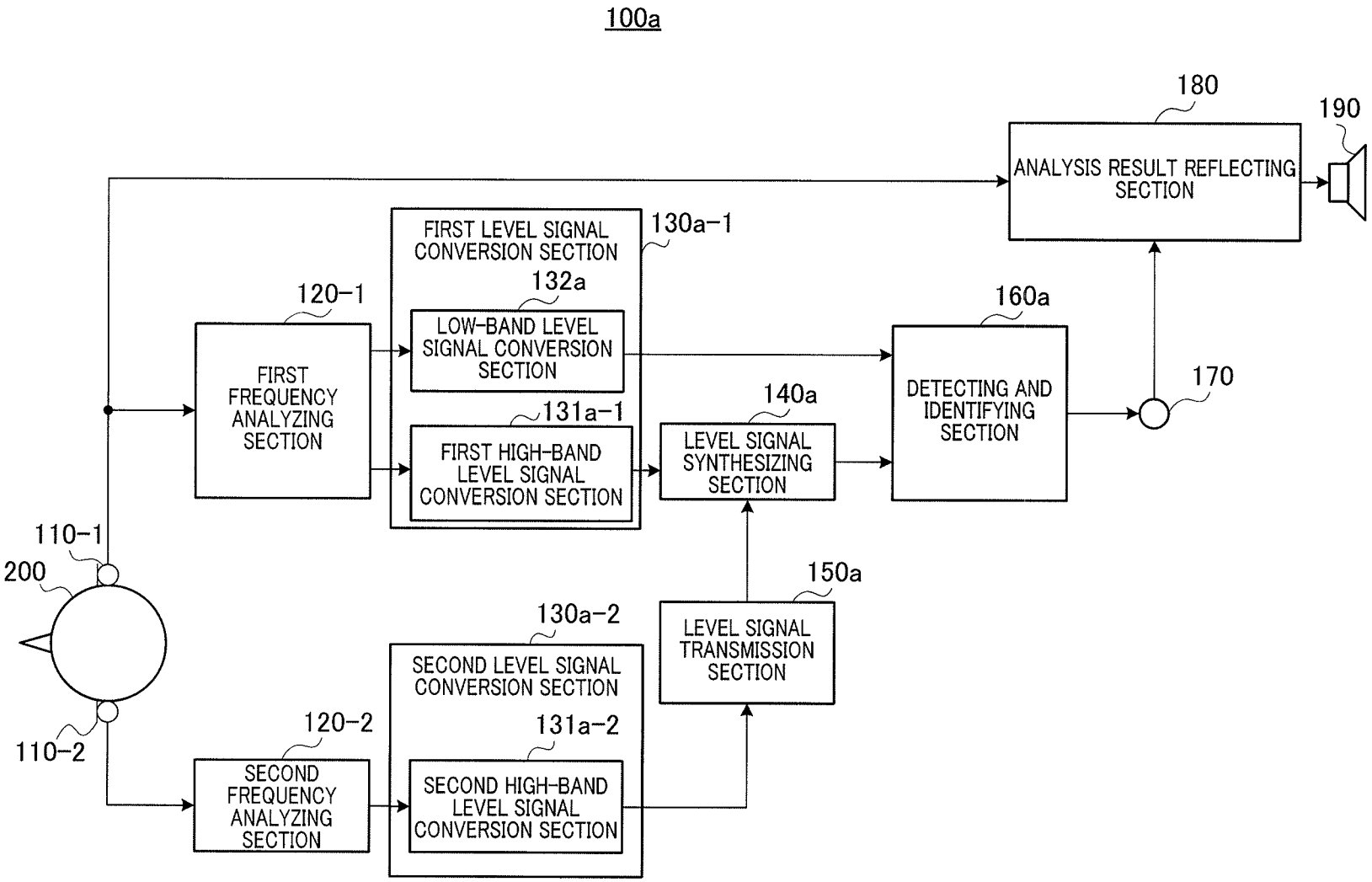
FIG. 13 is a block diagram that shows one example of a configuration of a sound processing apparatus in accordance with Embodiment 2 of the present invention.

FIG. 13 is a block diagram that shows one example of a configuration of a sound processing apparatus according to the present embodiment, which corresponds to FIG. 2 of Embodiment 1. Those portions that are the same as in FIG. 2 will be assigned the same reference numerals, and the descriptions thereof will not be repeated.

In FIG. 13, first level signal conversion section **130*a*-1 of sound processing apparatus 100*a* is provided with first high-band level signal conversion section 131*a*-1 and low-band level signal conversion section 132*a*. Second level signal conversion section 130*a*-2 of sound processing apparatus 100*a* is provided with second high-band level signal conversion section 131*a*-2. Moreover, sound processing apparatus 100*a* is provided with level signal synthesizing section 140*a*, level signal transmission section 150*a*, and detecting and identifying section 160*a***, whose objects of processing are different from the objects of processing in Embodiment 1.

Of the first frequency signals, first high-band level signal conversion section **131*a*-1 converts a high-band frequency signal into a signal indicating a sound-pressure level. Moreover, first high-band level signal conversion section 131*a*-1** outputs the converted signal to level signal synthesizing section 140*a* as a first high-band level signal.

Of the first frequency signals, low-band level signal conversion section 132*a* converts a low-band frequency signal into a signal indicating a sound pressure level. Then, low-band level signal conversion section 132*a* outputs the converted signal to detecting and identifying section 160*a* as a low-band level signal.

Of the second frequency signals, second high-band level signal conversion section 131*a*-2 converts a high-band frequency signal into a signal indicating a sound-pressure level. Moreover, second high-band level signal conversion section 131*a*-2 outputs the converted signal to level signal transmission section 150*a* as a second high-band level signal.

Only the second high-band level signal is input to level signal transmission section 150*a*, and with respect to the low-band of the second frequency signal, no level signal is input. Therefore, level signal transmission section 150*a* does not transmit a low-band level signal of the second level signals that are transmitted in Embodiment 1.

Level signal synthesizing section 140*a* generates a synthesized level signal formed by synthesizing the first high-band level signal and the second high-band level signal, and outputs the resulting signal to detecting and identifying section 160*a*.

Based upon the synthesized level signal and low-band level signal, detecting and identifying section 160*a* analyzes ambient sound, and outputs the result of this analysis to output section 170. For example, detecting and identifying section 160*a* analyzes the ambient sound based upon a combined signal between a signal formed by doubling the low-band level signal and the synthesized level signal.

Additionally, second level signal conversion unit 130*a*-2 may also generate a level signal with respect to the low-band, in the same manner as in Embodiment 1. In this case, detecting and identifying section 160*a* extracts only the high-band level signal from all the input level signals (that is, the second level signal in Embodiment 1), and transmits the resulting signal as a second high-band level signal.

Figure 14:
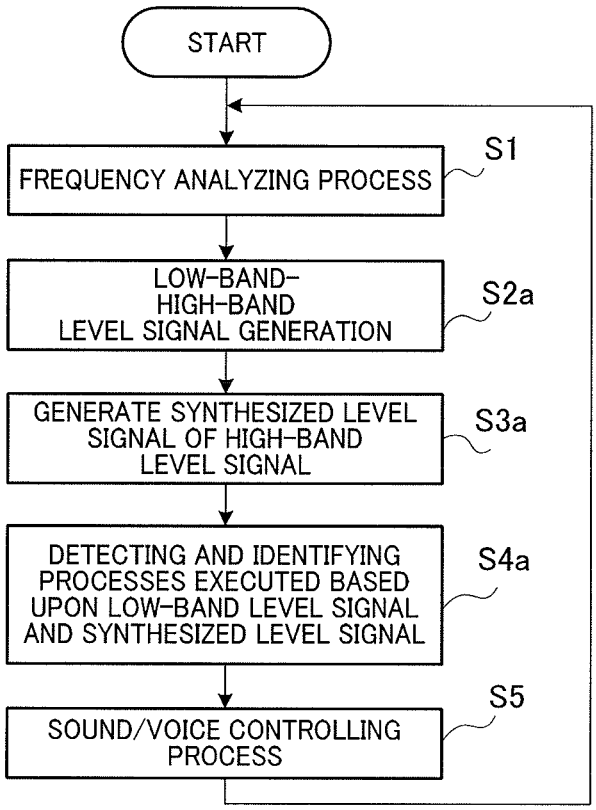
FIG. 14 is a flow chart that shows one example of operations in the sound processing apparatus in accordance with Embodiment 2.

FIG. 14 is a flow chart that shows one example of operations of sound processing apparatus 100*a*, which correspond to FIG. 12 of Embodiment 1. Those steps that are the same as in FIG. 12 will be assigned the same step numbers, and the descriptions thereof will not be repeated.

In step S2*a*, first level signal conversion section 130*a*-1 generates first high-band level signal and low-band level signal from the first frequency signal. Moreover, second level signal conversion section 130*a*-2 generates a second high-band level signal from the second frequency signal. The second high-band level signal is transmitted to right-side level signal synthesizing section 140*a* of the right-side hearing aid through level signal transmission section 150*a*.

Moreover, in step S3*a*, level signal synthesizing section 140*a* adds the first high-band level signal to the second high-band level signal so that a synthesized level signal is generated.

In step S4*a*, detecting and identifying section 160*a* carries out detecting and identifying processes by using the final synthesized level signal that is obtained by synthesizing the high-band synthesized level signal and the low-band level signal.

Figure 15:
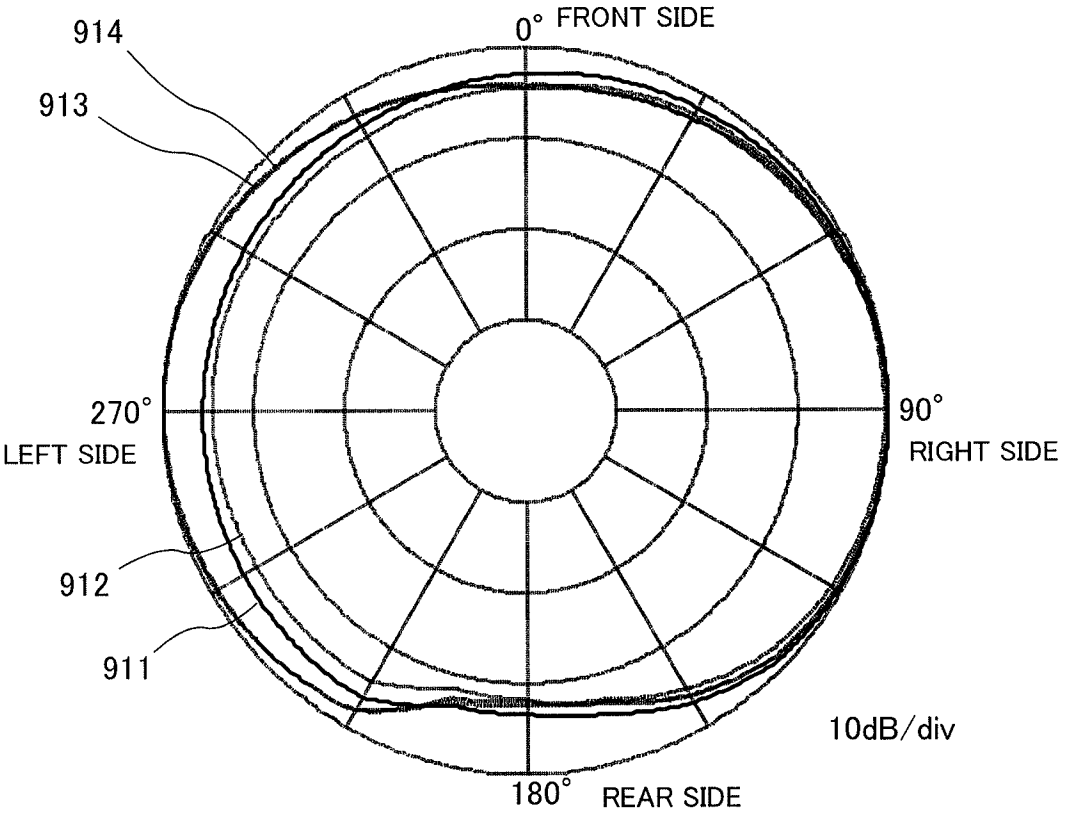
FIG. 15 is a drawing that shows experimental results of a directional characteristic of a final synthesized level signal in accordance with Embodiment 2.

FIG. 15 is a drawing that shows experimental results of directivity characteristics for each of frequencies of the final synthesized level signal in the present embodiment, which corresponds to FIGS. 1 and 10. In this example, filter banks are used as first frequency analyzing section 120-1 and second frequency analyzing section 120-2, with the border frequency being 800 Hz.

As shown in FIG. 15, it is found that not only directivity characteristics 913 and 914 at high bands of 800 Hz and 1600 Hz, but also directivity characteristics 911 and 912 at low bands of 200 Hz and 400 Hz have become more uniform than those of FIG. 1. That is, it is found that in the present embodiment, the signal to be analyzed has an improved uniformity in directivity characteristics in comparison with that of the related art. Since, with respect to the high band, level signals generated from two collected sound signals are synthesized in the same manner as in Embodiment 1, no dips as found in FIG. 10 are observed.

In this sound processing apparatus 100*a*, with respect to a level signal having a frequency band in which directivity characteristics of collected sound are not made significantly different between the first sound collector and the second sound collector, this signal is not transmitted and is not subject to the synthesizing operation between the right and left sides. That is, sound processing apparatus 100*a* transmits only the second high-band level signal generated from the high-band of the second collected sound signal. With this arrangement, sound processing apparatus 100*a* makes it possible to reduce the amount of data to be transmitted so that, even in the case of a small transmission capacity such as a radio transmission path, detecting and identifying processes using a signal having a comparatively uniform directional characteristic can be carried out. Therefore, sound processing apparatus 100*a* can achieve a small-size hearing aid with reduced power consumption.

Embodiment 3

Embodiment 3 of the present invention exemplifies a configuration which analyzes ambient sound by using only a signal having a limited frequency band within an audible frequency range. In this embodiment, an explanation will be given by exemplifying an arrangement in which a synthesized level signal is generated based upon only a level signal of a collected sound signal having a frequency at one point within a high band (hereinafter referred to as "a high-band specific frequency") and a level signal of a collected sound signal having a frequency at one point within a low band (hereinafter referred to as "a low-band specific frequency").

Figure 16:
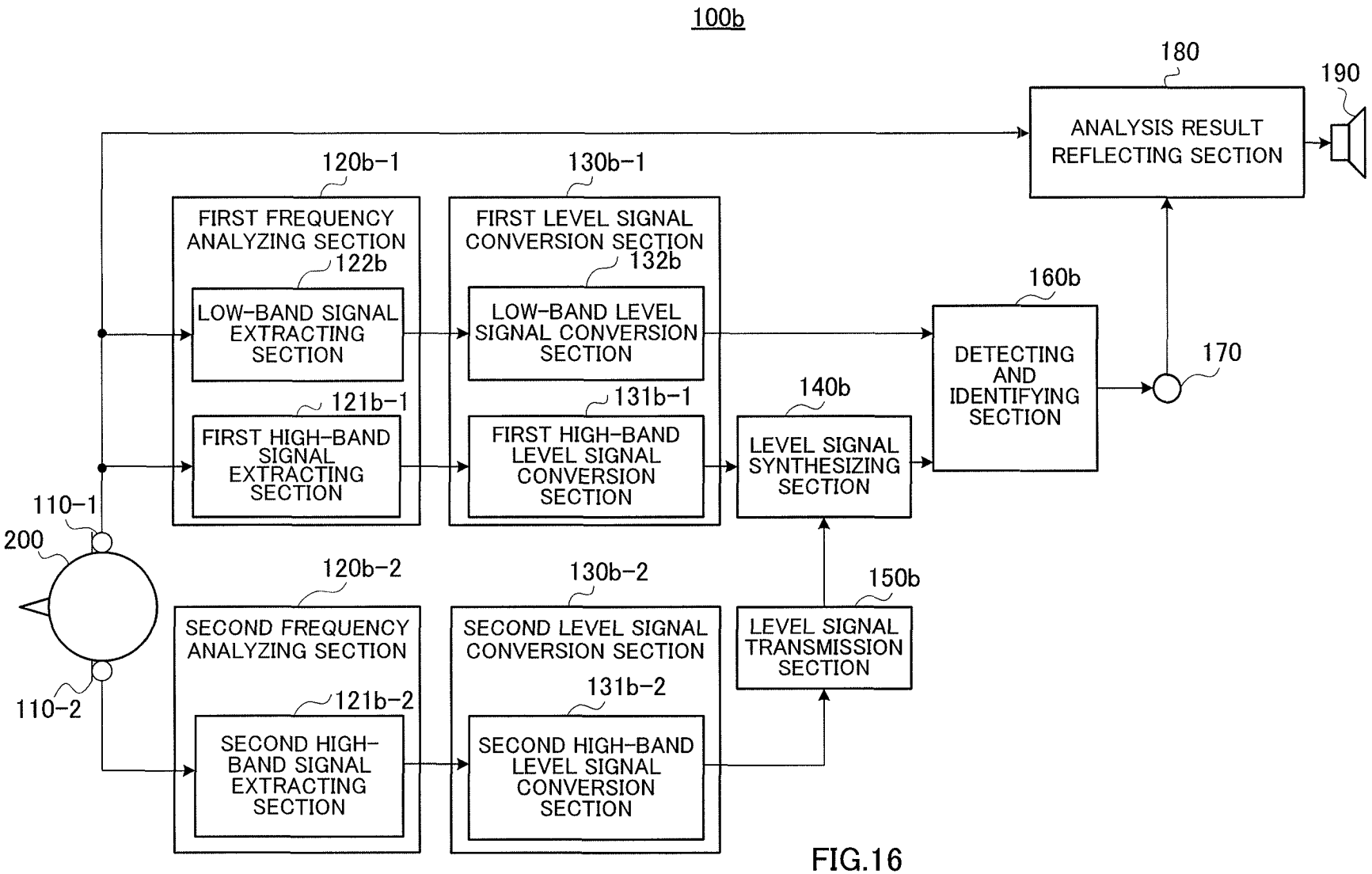
FIG. 16 is a block diagram that shows principle-part configurations of a sound processing apparatus in accordance with Embodiment 3 of the present invention.

FIG. 16 is a block diagram that shows a principle-part configuration of the sound processing apparatus according to the present embodiment, which corresponds to FIG. 13 of Embodiment 2. Those portions that are the same as in FIG. 13 will be assigned the same reference numerals, and the descriptions thereof will not be repeated.

In FIG. 16, first frequency analyzing section 120*b*-1 of sound processing apparatus 100*b* is provided with first high-band signal extracting section 121*b*-1 and low-band signal extracting section 122*b*. Second frequency analyzing section 120*b*-2 of sound processing apparatus 100*b* is provided with second high-band signal extracting section 121*b*-2. First level signal conversion section 130*a*-1 of sound processing apparatus 100*b* is provided with first high-band level signal conversion section 131*b*-1 and low-band level signal conversion section 132*b* having objects of processing that are different from those of Embodiment 2. Second level signal conversion section 130*a*-2 of sound processing apparatus 100*b* is provided with second high-band level signal conversion section 131*b*-2 having an object to be processed that is different from that of Embodiment 2. Moreover, sound processing apparatus 100*b* is provided with level signal synthesizing section 140*b*, level signal transmission section 150*b*, and detecting and identifying section 160*b*, whose objects of processing are different from the objects of processing in Embodiment 2.

First high-band signal extracting section 121*b*-1 outputs a frequency signal prepared by extracting only the component of a high-band specific frequency from the first collected sound signal (hereinafter referred to as "first frequency signal of high-band specific frequency") to first high-band level signal conversion section 131*b*-1. First high-band signal extracting section 121*b*-1 extracts the component of a high-band specific frequency by using, for example, a HPF (high pass filter) whose cut-off frequency has been determined based upon the border frequency.

Second high-band signal extracting section 121*b*-2 is the same as first high-band signal extracting section 121*b*-1. Second high-band signal extracting section 121*b*-2 outputs a frequency signal prepared by extracting only the component of a high-band specific frequency from the second collected sound signal (hereinafter referred to as "second frequency signal of high-band specific frequency") to second high-band level signal conversion section 131*b*-2.

Low-band signal extracting section 122*b* outputs a frequency signal prepared by extracting only the component of a low-band specific frequency from the first collected sound signal (hereinafter referred to as "frequency signal of low-band specific frequency") to low-band level signal conversion section 132*b*. Low-band signal extracting section 122*b* extracts a component of the low-band specific frequency by using a LPF (low pass filter) whose cut-off frequency has been determined based upon the border frequency.

First high-band level signal conversion section 131*b*-1 converts the first frequency signal of the high-band specific frequency to a signal indicating a sound pressure level, and outputs this to level signal synthesizing section 140*b* as the first level signal of the high-band specific frequency.

Second high-band level signal conversion section 131*b*-2 converts the second frequency signal of the high-band specific frequency to a signal indicating a sound pressure level, and outputs this to level signal transmission section 150*b* as the second level signal of the high-band specific frequency.

Low-band level signal conversion section 132*b* converts a frequency signal of the low-band specific frequency to a signal indicating a sound pressure level, and outputs this to detecting and identifying section 160*b* as a level signal of the low-band specific frequency.

To level signal transmission section 150*b*, only the second level signal of the high-band specific frequency is input. Therefore, level signal transmission section 150*b* does not transmit the level signal other than the high-band specific frequency of the second high-band level signals that are transmitted in Embodiment 2.

Level signal synthesizing section 140*b* generates a synthesized level signal prepared by synthesizing the first level signal of the high-band specific frequency and the second level signal of the high-band specific frequency, and outputs this to detecting and identifying section 160*b*.

Based upon the synthesized level signal and the level signal of the low-band specific frequency, detecting and identifying section 160*b* analyzes the ambient sound, and outputs the result of the analysis to output section 170. For example, detecting and identifying section 160*b* analyzes the ambient sound based upon a combined signal between a signal formed by doubling the level signal of the low-band specific frequency and the synthesized level signal. In other words, the combination between the synthesized level signal and the level signal of the low-band specific frequency in the present embodiment contains frequency spectrum information relating to only the two points of the high-band specific frequency and low-band specific frequency. Therefore, detecting and identifying section 160*b* carries out comparatively simple detecting and identifying processes by only focusing on the frequency spectra of the two points.

Figure 17:
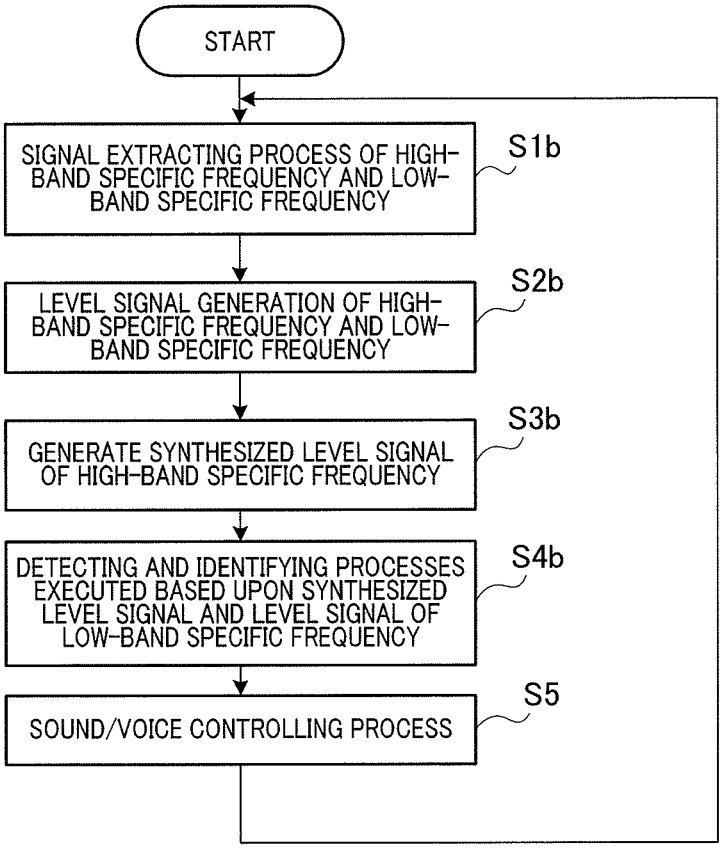
FIG. 17 is a flow chart that shows one example of operations in the sound processing apparatus in accordance with Embodiment 3.

FIG. 17 is a flow chart that shows one example of operations of sound processing apparatus 100*b*, which corresponds to FIG. 14 of Embodiment 2. Those steps that are the same as in FIG. 14 will be assigned the same step numbers, and the descriptions thereof will not be repeated.

First, in step S1*b*, first high-band signal extracting section 121*b*-1 extracts the first frequency signal of the high-band specific frequency from the first collected sound signal. Second high-band signal extracting section 121*b*-2 extracts the second frequency signal of the high-band specific frequency from the second collected sound signal. Moreover, low-band signal extracting section 122*b* extracts the frequency signal of the low-band specific frequency from the first collected sound signal.

Moreover, in step S2*b*, first high-band level signal conversion section 131*b*-1 generates a first level signal of the high-band specific frequency from the first frequency signal of the high-band specific frequency. Second high-band level signal conversion section 131*b*-2 generates a second level signal of the high-band specific frequency from the second frequency signal of the high-band specific frequency. Moreover, low-band level signal conversion section 132*b* generates a level signal of the low-band specific frequency from the frequency signal of the low-band specific frequency.

Furthermore, in step S3*b*, level signal synthesizing section 140*b* adds the second level signal of the high-band specific frequency to the first level signal of the high-band specific frequency so that a synthesized level signal is generated.

In step S4*b*, detecting and identifying section 160*b* carries out detecting and identifying processes by using the final synthesized level signal obtained by synthesizing the synthesized level signal of the high-band specific frequency and the level signal of the low-band specific frequency.

This sound processing apparatus 100*b* transmits only the level signal having one portion of the frequency band, that is, the frequency band (high band) in which directivity characteristics of collected sound are significantly different between the two sound collectors, between the hearing aids. That is, sound processing apparatus 100*b* does not transmit unnecessary level signals in association with the analysis precision. Thus, sound processing apparatus 100*b* can analyze ambient sound based upon a synthesized signal having a uniform sound-pressure frequency characteristic, even in the case when the transmission capacity between the hearing aids is extremely small.

Additionally, in the present embodiment, the frequencies to be transmitted are defined as the two points, that is, the high-band specific frequency and the low-band specific frequency; however, not limited to this arrangement, it is only necessary to include at least one point of frequencies where directivity characteristics of collected sound are significantly different between the two sound collectors. For example, the frequencies to be transmitted may be only one point in the high band, or may be three or more therein.

Embodiment 4

In particular, in the case of a hearing aid, it is not preferable to generate an unpleasant sound like a sound generated when a vinyl sheet is crashed near the sound collector, as it is, from the sound/voice output section. For this reason, in Embodiment 4 of the present invention, an arrangement is proposed in which a predetermined sound is detected from the collected sound signal, and under the condition that the predetermined sound has been detected, a process for reducing the sound volume is carried out, and the following description will discuss one example of these operations and a specific configuration thereof.

Normally, frequency spectral energy of environmental noise (sound from an air conditioner or mechanical sound) or voice (sound of speaking voice from a person) mainly lies in a low frequency band. For example, the frequency spectral energy of voice is mainly concentrated in a band of 1 kHz or less. Moreover, with voice, the spectral inclination for a long period of time from the low frequency band to the high frequency band has a shape that gradually attenuates from about 1 kHz as a border toward the high frequency band at a rate of −6 dB/oct. On the other hand, the above-mentioned unpleasant sound has a spectrum characteristic that is close to white noise, which has a comparatively flat shape from the low frequency band to the high frequency band. In other words, this unpleasant sound is characterized in that its amplitude spectrum is comparatively flat. Therefore, the sound processing apparatus of the present embodiment carries out a detection of an unpleasant sound based upon whether the amplitude spectrum is flat or not. Then, upon detection of such an unpleasant sound, the sound processing apparatus of the present embodiment suppresses the sound volume of a reproduced sound so as to alleviate an unpleasant feeling from received sound.

Figure 18:
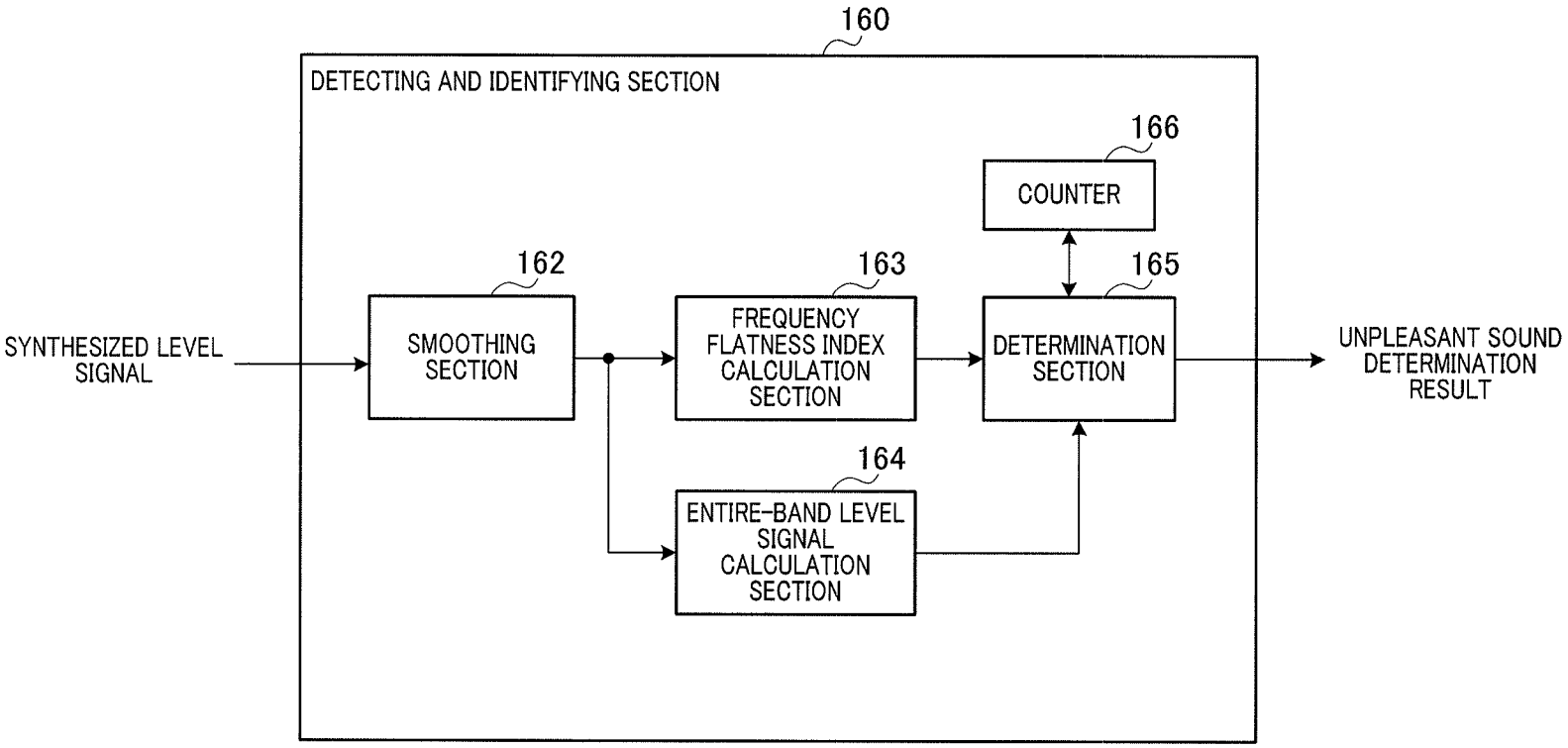
FIG. 18 is a drawing that shows one example of a configuration of a detecting and identifying section in Embodiment 4 of the present invention.

FIG. 18 is a drawing that shows one example of a configuration of a detecting and identifying section in the present embodiment. This detecting and identifying section is used as detecting and identifying section 160 shown in FIG. 2 of Embodiment 1.

In FIG. 18, detecting and identifying section 160 is provided with smoothing section 162, frequency flatness index calculation section 163, entire-band level signal calculation section 164, determination section 165 and counter 166.

Smoothing section 162 smoothes the synthesized level signal input from level signal synthesizing section 140 so that it generates a smoothed, synthesized level signal. Moreover, smoothing section 162 outputs the smoothed, synthesized level signal thus generated to frequency flatness index calculation section 163 and entire-band level signal calculation section 164. Smoothing section 162 carries out the smoothing process on the synthesized level signal by using, for example, a LPF.

Frequency flatness index calculation section 163 verifies the flatness of the base synthesized level signal on the frequency axis by using the smoothed, synthesized level signal, and calculates a frequency flatness index that indicates the degree of flatness. Then, frequency flatness index calculation section 163 outputs the frequency flatness index thus calculated to determination section 165.

Entire-band level signal calculation section 164 calculates the entire frequency level in a predetermined entire frequency band (for example, audible band) by using the smoothed, synthesized level signal, and outputs the results of calculations to determination section 165.

Determination section 165 determines whether or not any unpleasant sound is included in ambient sound based upon the frequency flatness index and the entire frequency level, and outputs the result of determination about unpleasant sound to output section 170. More specifically, by using counter 166, determination section 165 counts a period of time (hereinafter referred to as "continuous determined period of time") during which a continuous determination that any unpleasant sound is contained in ambient sound has been made, as a period of time that continuously has any unpleasant sound. Moreover, during a period in which the continuous determined period of time exceeds a predetermined threshold value, determination section 165 outputs a result of determination indicating that any unpleasant sound has been detected, and in contrast, when the continuous determined period of time does not exceed the predetermined threshold value, it outputs a result of determination indicating that no unpleasant sound has been detected.

This detecting and identifying section 160 makes it possible to detect any unpleasant sound based upon the synthesized level signal.

In the present embodiment, output section 170 is designed to output a control signal whose control flag is switched on and off in response to the input result of determination to analysis result reflecting section 180.

Figure 19:
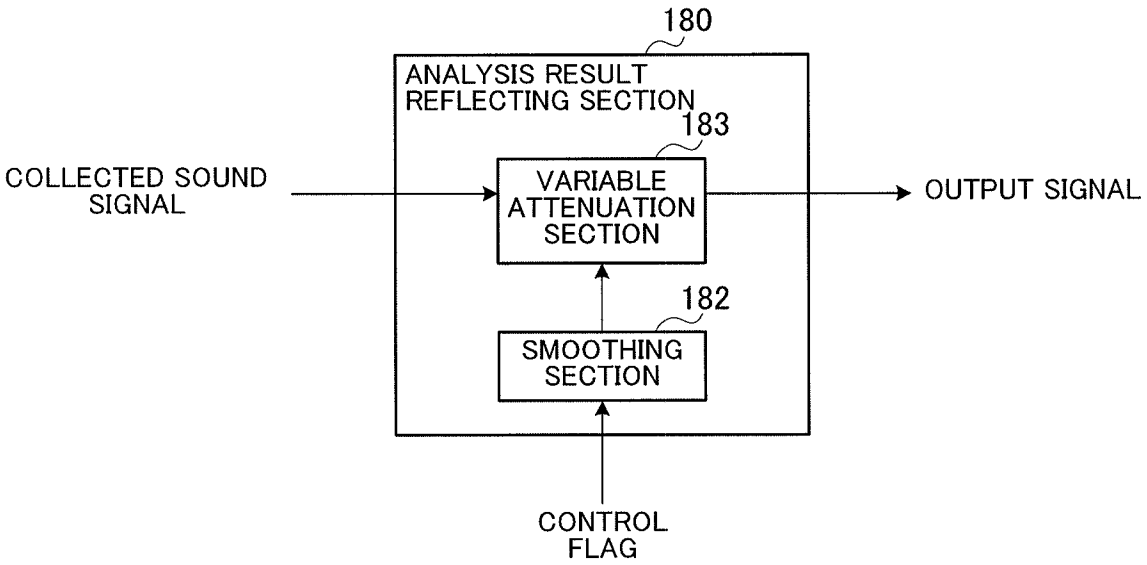
FIG. 19 is a block diagram that shows one example of a configuration of an analysis result reflecting section in Embodiment 4 of the present invention.

FIG. 19 is a block diagram that shows one example of a configuration of analysis result reflecting section 180.

Smoothing section 182 smoothes the control signal from output section 170, and generates a smoothing control signal. Moreover, smoothing section 182 outputs the smoothing control signal thus generated to variable attenuation section 183. That is, the smoothing control signal is a signal used for smoothly changing the sound volume in response to on/off of the control signal. Smoothing section 182 carries out the smoothing process with respect to the control signal by using, for example, a LPF.

Based upon the smoothing control signal, the variable attenuation section 183 carries out a process for reducing the sound volume on the condition that any unpleasant sound has been detected in the first collected sound signal, and outputs a first collected sound signal subjected to such a process to sound/voice output section 190.

Figure 20:
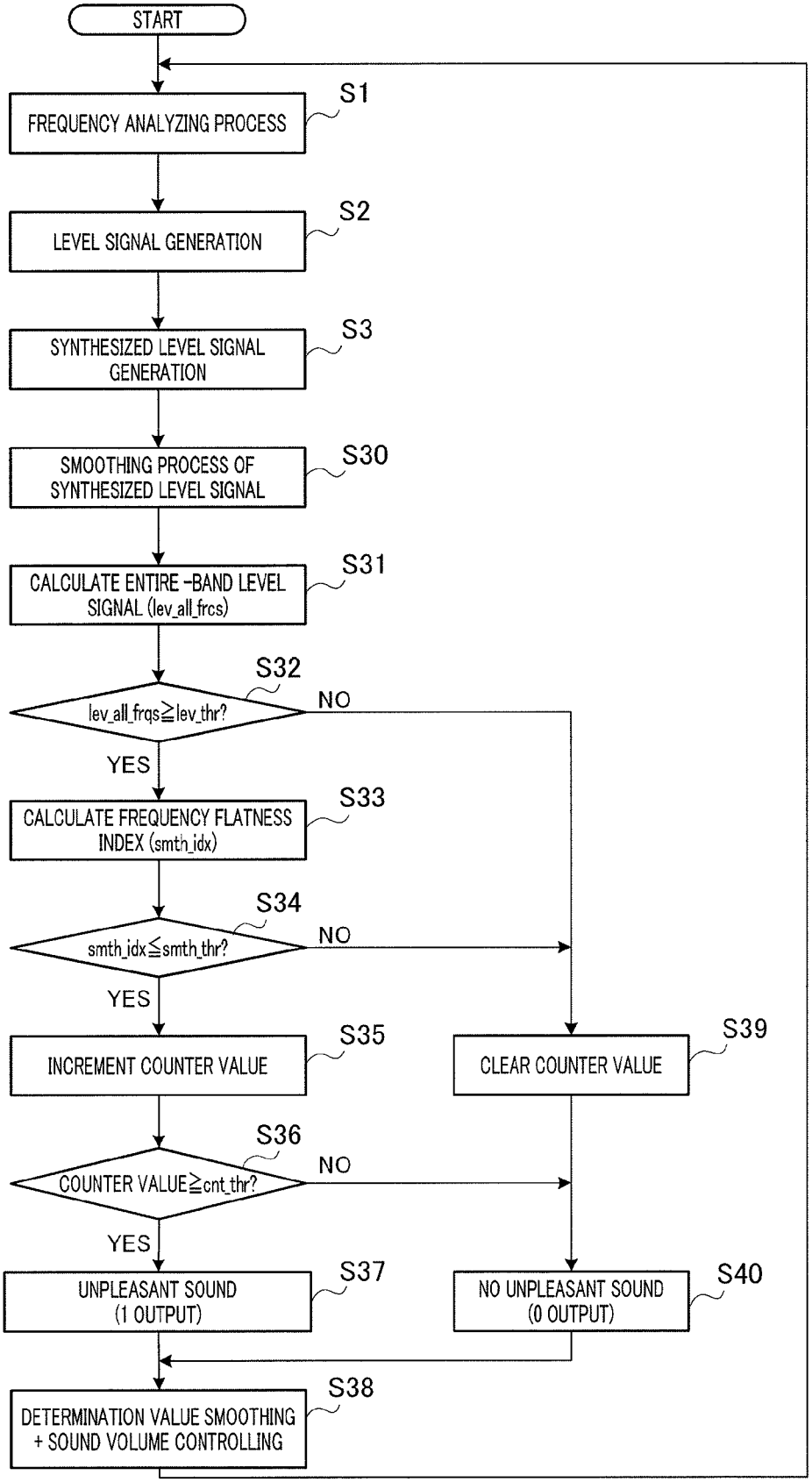
FIG. 20 is a flow chart that shows one example of operations in a sound processing apparatus in accordance with Embodiment 4.

FIG. 20 is a flow chart that shows one example of operations of sound processing apparatus 100 according to the present embodiment, which corresponds to FIG. 12 of Embodiment 1. Those steps that are the same as in FIG. 12 will be assigned the same step numbers, and the descriptions thereof will not be repeated.

In step S30, smoothing section 162 of detecting and identifying section 160 smoothes the synthesized level signal for each of frequency bands, and calculates a smoothed, synthesized level signal lev_frqs(k). In this case, k represents a band division index, and in the case when N-division filter bank shown in FIG. 5 is used, k has a value in a range from 0 to N−1. In the following description, it is supposed that synthesized level signals have been obtained for the respective N-number of frequency bands.

Moreover, in step S31, entire-band level signal calculation section 164 adds smoothed, synthesized level signals lev_frqs (k) for the respective bands with respect to all the k's, and calculates entire-band level signal lev_all_frqs. Entire-band level signal calculation section 164 calculates the entire-band level signal lev_all_frqs by using, for example, the following equation 3.

Equation 3

$$\text{lev_all_frqs} = \sum_{k=0}^{N-1} \text{lev_frqs}(k) \quad [3]$$

Moreover, in step S32, determination section 165 first determines whether or not the first collected sound signal has such a sufficient level as to be subject to a suppressing process. More specifically, determination section 165 determines whether the entire-band level signal lev_all_frqs is a predetermined threshold value lev_thr or more. Then, in the case when the entire-band level signal lev_all_frqs is the predetermined threshold value lev_thr or more (S32: YES), the determination section 165 allows the sequence to proceed to step S33. In the case when the entire-band level signal lev_all_frqs is less than the predetermined threshold value lev_thr (S32: NO), the determination section 165 allows the sequence to proceed to step S39.

In step S33, frequency flatness index calculation section 163 calculates a frequency flatness index smth_idx indicating the flatness of the frequency spectrum from the smoothed, synthesized level signals lev_frqs(k) for each of bands. More specifically, frequency flatness index calculation section 163 calculates a level deviation for each of frequencies by using, for example, level dispersion of each of the frequencies, and the level deviation thus calculated is defined as the frequency flatness index smth_idx. Frequency flatness index calculation section 163 calculates the frequency flatness index smth_idx by using, for example, the following equation 4.

Equation 4

$$\text{smth_idx} = \frac{\sum_{k=0}^{N-1} (\text{lev_frqs}(k) - \text{lev_frqs_mean})^2}{N} \quad [4]$$

Here, in equation 4, lev_frqs_mean represents an average value of the smoothed, synthesized level signals lev_frqs(k). Frequency flatness index calculation section 163 calculates lev_frqs_mean by using, for example, the following equation 5.

Equation 5

$$\text{lev_frqs_mean} = \frac{\sum_{k=0}^{N-1} \text{lev_frqs}(k)}{N} \quad [5]$$

In step S34, determination section 165 determines whether or not the frequency spectrum of the synthesized level signal is flat. More specifically, determination section 165 determines whether the frequency flatness index smth_idx is predetermined threshold value smth_thr or less. Then, in the case when the frequency flatness index smth_idx is predetermined threshold value smth_thr or less (S34: YES), the determination section 165 allows the sequence to proceed to step S35. In the case when the frequency flatness index smth_idx exceeds the predetermined threshold value smth_thr (S34: NO), the determination section 165 allows the sequence to proceed to step S39.

In step S35, determination section 165 increments the counter value of counter 166.

Moreover, in step S36, determination section 165 determines whether or not the collected sound level is sufficient, with the spectrum being kept in a flat state for a threshold count. More specifically, determination section 165 determines whether or not the counter value of counter 166 is a predetermined threshold count cnt_thr or more. In the case when the counter value is the predetermined threshold count cnt_thr or more (S36: YES), the determination section 165 allows the sequence to proceed to step S37. In the case when the counter value is less than the predetermined threshold count cnt_thr (S36: NO), the determination section 165 allows the sequence to proceed to step S40.

In step S37, determination section 165 determines that there is an unpleasant sound, and sets "1" indicating the presence of an unpleasant sound in a control flag (ann_flg(n)) of the control signal to be output to output section 170. In this case, n represents the present time.

On the other hand, in step S39, determination section 165 clears the counter value of counter 166, and the sequence proceeds to step S40.

Moreover, in step S40, determination section 165 determines that there is no unpleasant sound, and sets "0" indicating no unpleasant sound in the control flag (ann_flg(n)) of the control signal to be output to output section 170.

In step S38, analysis result reflecting section 180 receives the control flag (ann_flg(n)). Next, based upon a smoothing control flag (ann_flg_smt(n)) (that is, a smoothing control signal) used for smoothing in smoothing section 182, analysis result reflecting section 180 suppresses the collected sound signal of first sound collector 110-1(110-2) by using variable attenuation section 183.

By using, for example, a primary integrator represented by the following equation 6, smoothing section 182 of analysis result reflecting section 180 calculates the smoothing control flag (ann_flg_smt(n)). In this case, α is a value that is significantly smaller than 1. Moreover, ann_flg_smt(n−1) corresponds to a smoothing control flag of the previous time by one count time.

[6]

$$\text{ann_flg_smt}(n) = \alpha \cdot \text{ann_flg}(n) + (1-\alpha) \cdot \text{ann_flg_smt}(n-1) \quad \text{Equation 6}$$

Moreover, supposing that the input signal to the sound volume control section is x(n), variable attenuation section 183 of analysis result reflecting section 180 calculates the value (output value) y(n) of the output signal by using the following equation 7.

[7]

$$y(n) = \text{att}(n) \cdot x(n) \quad \text{Equation 7}$$

Additionally, att(n) in equation 7 is a value indicating the amount of attenuation at time n. Analysis result reflecting section 180 calculates att(n) by using the following equation 8, for example, based upon a fixed maximum amount of attenuation att_max. The fixed maximum amount of attenuation att_max is a parameter that determines the maximum amount of attenuation of att(n), and in an attempt to realize a suppression of, for example, a maximum 6 dB, this is 0.5.

[8]

$$\text{att}(n) = 1 - \text{att_max} \cdot \text{ann_flg_smt}(n) \quad \text{Equation 8}$$

Upon detection of an unpleasant sound, this sound processing apparatus 100 makes it possible to reduce the reproduced sound volume of ambient sound. Moreover, as explained in Embodiment 1, sound processing apparatus 100 generates a synthesized level signal as a level signal of ambient sound in which both of acoustic influence from the head and a space aliasing phenomenon are suppressed. Therefore, sound processing apparatus 100 of the present embodiment detects an unpleasant sound with high accuracy, and positively carries out the reduction of sound volume of the unpleasant sound.

As a signal to be sound-volume-controlled by analysis result reflecting section 180, the first collected sound signal is used in the present embodiment; however, the present invention is not intended to be limited by this. For example, analysis result reflecting section 180 may use the first collected sound signal after having been subjected to a directional characteristic synthesizing process, a nonlinear compression process, and the like, as the object to be processed, and the volume-controlling process may be carried out thereon.

Moreover, in the present embodiment, the ways how to decide the frequency band to be subject to the sound volume control by analysis result reflecting section 180 and how to reduce the sound volume are executed as a constant sound volume reduction over the entire frequency bands (see equation 6); however, the present invention is not intended to be limited by this arrangement. For example, analysis result reflecting section 180 may be designed to reduce the sound volume relative to only the limited frequency band, or to reduce the sound volume to a greater extent as the relevant frequency becomes higher. In this case, detecting and identifying section 160 may be designed to calculate only the parameter relating to the frequency band to be subject to the reduction. In other words, for example, in the aforementioned equations 3 to 5, detecting and identifying section 160 may calculate respective parameters, by using one portion of the band indexes k=0 to N−1, such as, for example, the band indexes k=2 to N−2.

In the above-mentioned respective embodiments, the analysis result reflecting section is supposed to be placed on the right-side hearing aid; however, this may be placed on the left-side hearing aid. In this case, the level signal transmission section, placed on the right-side hearing aid, transmits the first level signal to the left-side hearing aid. Moreover, the level signal synthesizing section, the detecting and identifying section and the output section are placed on the left-side hearing aid.

Furthermore, the frequency band to be subject to the synthesizing process for the level signal is supposed to be a high band in the respective embodiments explained above; however, not limited to this, any frequency band may be used as long as its directivity characteristics of collected sound are significantly different between the two sound collectors and it can be used for analysis.

The level signal synthesizing section, detecting and identifying section, output section and analysis result reflecting section may be placed in a manner separated from the two hearing aids. In this case, level signal transmission sections are required for the two hearing aids.

The application of the present invention is not intended to be limited only to hearing aids. The present invention may be applied to various apparatuses that analyze ambient sound based upon collected sound signals acquired by two sound collectors. In the case when the object of analysis of ambient sound is a human head, examples of these apparatuses include headphone stereo apparatuses, hearing aids of a head-set-integrated type, etc., which are used with two microphones being attached to the head. Moreover, the present invention may be applied to various apparatuses, which, by using the result of analysis of ambient sound, carry out a reduction of sound volume, a warning operation for attracting attentions, and the like.

As described above, the sound processing apparatus of the present embodiment, which analyzes ambient sound based upon collected sound signals acquired by two sound collectors, is provided with: a level signal conversion section which, for each of collected sound signals, converts the collected sound signal into a level signal, from which phase information is removed; a level signal synthesizing section that generates a synthesized level signal in which the level signals obtained from the collected sound signals from the two sound collectors are synthesized; and a detecting and identifying section that analyzes the ambient sound based upon the synthesized level signal, and makes it possible to improve the accuracy of analysis of ambient sound.

This disclosure of Japanese Patent Application No. 2010-38903, filed on Feb. 24, 2010, including the specification, drawings and abstract, is incorporated herein by reference in its entirety.

INDUSTRIAL APPLICABILITY

The sound processing apparatus and sound processing method of the present invention are effectively applied as a sound processing apparatus and a sound processing method that can improve the accuracy of analysis of ambient sound.

REFERENCE SIGNS LIST

100, 100*a*, 100*b* Sound processing apparatus
110-1 First sound collector
110-2 Second sound collector
120-1, 120*b*-1 First frequency analyzing section
120-2, 120*b*-2 Second frequency analyzing section
121*b*-1 First high-band signal extracting section
121*b*-2 Second high-band signal extracting section
122*b* Low-band signal extracting section
130-1, 130*a*-1, 130*b*-1 First level signal conversion section
130-2, 130*a*-2, 130*b*-2 Second level signal conversion section
131*a*-1, 131*b*-1 First high-band level signal conversion section
131*a*-2, 131*b*-2 Second high-band level signal conversion section
132*a*, 132*b* Low-band level signal conversion section
140, 140*a*, 140*b* Level signal synthesizing section
150, 150*a*, 150*b* Level signal transmission section
160, 160*a*, 160*b* Detecting and identifying section
162 Smoothing section
163 Frequency flatness index calculation section
164 Entire-band level signal calculation section
165 Determination section
166 Counter
170 Output section
180 Analysis result reflecting section
190 Sound/voice output section
300-1 Right-side hearing aid
300-2 Left-side hearing aid
310 Hearing aid main body
320 Acoustic tube
330 Earphone

The invention claimed is:

1. A sound processing apparatus, which analyzes ambient sound based upon collected sound signals acquired by two sound collectors, the sound processing apparatus comprising:

a processor that executes instructions stored in a memory, comprising a level signal converter which, for each the of collected sound signals, converts the collected sound signal into a level signal having a plurality of frequency bands, which indicates an absolute value of the collected sound signal and from which phase information is removed;

a level signal synthesizer that generates a synthesized level signal in which the level signals of a single portion of the frequency bands obtained from the collected sound signals from the two sound collectors are synthesized; and a detector/identifier that analyzes the ambient sound based upon the synthesized level signal.

2. The sound processing apparatus according to claim 1, wherein the two sound collectors include a first sound collector attachable to a right ear of a person, and a second sound collector attachable to a left ear of the person.

3. The sound processing apparatus according to claim 2, wherein the processor further comprises a frequency analyzer that converts the collected sound signals to a frequency signal for each of frequency bands, for each of the collected sound signals, wherein:

the level signal converter converts the frequency signal into a level signal, from which phase information is removed, for each of the frequency signals; and the level signal synthesizer uses a signal, obtained by adding the level signals acquired from the collected sound signals from the two sound collectors, for each of the frequency bands, as the synthesized level signal.

4. The sound processing apparatus according to claim 3, wherein:

two pairs of the frequency analyzer and the level signal converters are provided respectively for the first sound collector and the second sound collector;

the frequency analyzer and the level signal converter associated with the first sound collector are placed in the first apparatus having the first sound collector that is attached to a right ear;

the frequency analyzer and the level signal converter associated with the second sound collector are placed in the second apparatus having the second sound collector that is attached to a left ear;

the level signal synthesizer and the detector/identifier are provided inside one of the first apparatus and the second apparatus; and a level signal transmitter that transmits a level signal generated on the side that is not provided together with the level signal synthesizer, to the level signal synthesizer.

5. The sound processing apparatus according to claim 1, wherein the detector/identifier further comprises:

an analysis result reflector that detects a predetermined sound contained in ambient sound, and when the predetermined sound has been detected, reduces a sound volume of the collected sound signal; and a sound/voice output that converts the collected sound signal that has been processed by the analysis result reflector into sound, and outputs the sound.

6. The sound processing apparatus according to claim 1, wherein the detector/identifier further comprises an analysis result reflector that detects a predetermined sound contained in ambient sound, and when the predetermined sound has been detected, carries out a predetermined warning operation.

7. The sound processing apparatus according to claim 1, wherein the level signal synthesizer generates the synthesized level signal, in which the level signals obtained from the collected sound signals from the two sound collectors are added.

8. The sound processing apparatus according to claim 1, wherein the synthesized level signal is obtained as a level signal having uniform directivity characteristics.

9. The sound processing apparatus according to claim 8, wherein the synthesized level signal forms an output amplitude value of a non-directive microphone array constituted by the two sound collectors.

10. A sound processing apparatus, which analyzes ambient sound based upon collected sound signals acquired by two sound collectors, the sound processing apparatus comprising:

a processor that executes instructions stored in a memory, comprising a level signal converter which, for each the of collected sound signals, converts the collected sound signal into a level signal, from which phase information is removed;

a level signal synthesizer that generates a synthesized level signal in which the level signals obtained from the collected sound signals from the two sound collectors are synthesized; and a detector/identifier section that analyzes the ambient sound based upon the synthesized level signal a frequency analyzer that converts the collected sound signals to a frequency signal for each of frequency bands, for each of the collected sound signals, the level signal converter converts the frequency signal into a level signal, from which phase information is removed, for each of the frequency signals;

the level signal synthesizer uses a signal, obtained by adding the level signals acquired from the collected sound signals from the two sound collectors, for each of the frequency bands, as the synthesized level signal;

wherein the two sound collectors include a first sound collector attachable to a right ear of a person, and a second sound collector attachable to a left ear of the person, two pairs of the frequency analyzer and the level signal converters are provided respectively for the first sound collector and the second sound collector;

the frequency analyzer and the level signal converter associated with the first sound collector are placed in the first apparatus having the first sound collector that is attached to a right ear;

the frequency analyzer and the level signal converter associated with the second sound collector are placed in the second apparatus having the second sound collector that is attached to a left ear;

the level signal synthesizer and the detector/identifies are provided inside one of the first apparatus and the second apparatus; and a level signal transmitter that transmits a level signal generated on the side that is not provided together with the level signal synthesizer, to the level signal synthesizer, wherein the level signal transmitter refrains from transmitting the level signal having a frequency band in which directivity characteristics of collected sound is not significantly different between the first sound collector, and the second sound collector to the level signal synthesizer.

11. The sound processing apparatus according to claim 10, wherein the level signal transmitter transmits only the level signal of one portion of the frequency bands in which the directivity characteristics of collected sound is significantly different between the first sound collector and the second sound collector to the level signal synthesizer.

12. A sound processing method, which analyzes ambient sound based upon collected sound signals acquired by two sound collectors, comprising:

for each of collected sound signals, converting the collected sound signal into a level signal having a plurality of frequency bands, which indicates an absolute value of the collected sound signals and from which phase information is removed;

generating a synthesized level signal in which the level signals of a single portion of the frequency bands obtained from the collected sound signals from the two sound collectors are added and synthesized; and analyzing the ambient sound based upon the synthesized level signal.

* * * * *